US012595959B2

(12) United States Patent
Hong

(10) Patent No.: US 12,595,959 B2
(45) Date of Patent: Apr. 7, 2026

(54) REFRIGERATOR

(71) Applicant: LG Electronics Inc., Seoul (KR)

(72) Inventor: Sangpyo Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 262 days.

(21) Appl. No.: 18/217,117

(22) Filed: Jun. 30, 2023

(65) Prior Publication Data

US 2024/0003613 A1 Jan. 4, 2024

(30) Foreign Application Priority Data

Jun. 30, 2022 (KR) ..... 10-2022-0080889

(51) Int. Cl.
*F25D 27/00* (2006.01)
*F25D 23/06* (2006.01)

(52) U.S. Cl.
CPC ..... *F25D 27/00* (2013.01); *F25D 23/063* (2013.01)

(58) Field of Classification Search
None
See application file for complete search history.

(56) References Cited

U.S. PATENT DOCUMENTS

| | | | | |
|---|---|---|---|---|
| 11,940,208 | B2 * | 3/2024 | Hong | F25D 29/005 |
| 12,235,035 | B2 * | 2/2025 | Song | F25D 27/00 |
| 12,235,036 | B2 * | 2/2025 | Park | F25D 23/02 |
| 12,241,678 | B2 * | 3/2025 | Hong | F25D 23/028 |
| 12,287,509 | B2 * | 4/2025 | Park | F25D 27/00 |
| 12,352,492 | B2 * | 7/2025 | Song | F25D 23/028 |
| 2014/0078407 | A1 | 3/2014 | Green et al. | |
| 2019/0257571 | A1 | 8/2019 | Park et al. | |
| 2021/0318061 | A1 | 10/2021 | Lee et al. | |
| 2023/0152028 | A1 * | 5/2023 | Song | A47L 15/4265 312/405 |
| 2024/0183606 | A1 * | 6/2024 | Kim | F25D 23/028 |
| 2025/0137717 | A1 * | 5/2025 | Yu | F25D 29/006 |

FOREIGN PATENT DOCUMENTS

| | | | | |
|---|---|---|---|---|
| CN | 205310976 U | * | 6/2016 | |
| FR | 2978525 A1 | * | 2/2013 | A47F 3/0434 |
| FR | 2978525 B1 | * | 5/2018 | A47F 11/10 |
| KR | 102554588 B1 | * | 7/2023 | F25B 21/02 |

OTHER PUBLICATIONS

Extended European Search Report in European Appln. No. 23182795.7, mailed on Nov. 3, 2023, 9 pages.

* cited by examiner

*Primary Examiner* — Hanh V Tran
(74) *Attorney, Agent, or Firm* — Fish & Richardson P.C.

(57) ABSTRACT

Provided is a refrigerator. The refrigerator comprises: a refrigerator door including a door body and a panel assembly, wherein the panel assembly comprises: a panel configured to transmit light therethrough, a back cover positioned at a rear surface of the panel, a lighting device configured to emit light toward the panel, a supporter supporting the lighting device, the support facing the back cover and configured to transfer heat generated at the lighting device to the back cover to thereby dissipate heat at the back cover, and a heat dissipation member positioned at the back cover and configured to dissipate heat transferred from the light supporter.

20 Claims, 25 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2022-0080889, filed on Jun. 30, 2022, which is hereby incorporated by reference in its entirety.

BACKGROUND

The present disclosure relates to a refrigerator.

In general, refrigerators are home appliances for storing foods at low temperature in an inner storage space covered by a refrigerator door. Here, the inside of the storage space is cooled using cool air that is generated by being heat-exchanged with a refrigerant circulated in a refrigeration cycle to store the foods in an optimal state.

Such refrigerators tend to increase more and more in size and provide multi-functions due to the trends of change of dietary life and high quality, and accordingly, refrigerators provided with various structures and convenience devices in consideration of user convenience are brought to the market.

In order to harmonize with an environment in which the refrigerator is disposed or with surrounding furniture or home appliances, structures for varying an outer appearance of a door front of the refrigerator are developed, and this trend is the same throughout the home appliance.

Representatively, U.S. Patent Application No. 8789900 discloses a structure in which a decoration panel defining an outer appearance is installed on a door front of a refrigerator, and here, the outer appearance of the door front is formed according to a user's preference by detachably configuring the decoration panel.

However, the refrigerator having this structure has a problem in that, when a user wants to change the outer appearance, the entire decoration panel needs to be removed and replaced, and it is not possible to use the decoration panel before replacement any longer.

To solve such a limitation, a refrigerator capable of changing an outer appearance of a front surface of a refrigerator door, that is, an outer appearance of a front surface of the refrigerator without disassembling the refrigerator door, has been developed.

Representatively, Chinese Patent Application No. 103250018 discloses a refrigerator in which a reflective layer and a transparent panel are disposed on a door front and colored light emitting members are mounted on both side ends of the reflective layer to cause the transparent panel to glow with set color.

However, in the refrigerator having such a structure, heat generated in the light emitting member is not effectively dissipated to cause excessive deformation of a light guide plate.

In addition, when the light emitting member is turned on for a long period of time, there is a limitation in that the light emitting member is deteriorated in durability or damaged.

In addition, a front surface of the door may be heated due to heat generated during an operation of the light emitting member. In addition, when the user touches the front surface of the heated door so as to open the door, there is a limitation in that the heat is transferred to the user's hand.

In addition, if an insulator is disposed to prevent the front surface of the door from being heated by the heat of the light emitting member, there is a limitation in that the overall thickness of the door increases.

SUMMARY

Embodiments provide a refrigerator capable of effectively dissipating heat generated in a lighting device provided inside a door.

Embodiments also provide a refrigerator that prevents a front surface of a door and a position adjacent to a handle from being heated when a lighting device is driven.

Embodiments also provide a refrigerator in which heat dissipation of a lighting device is improved to reduce thickness of a panel assembly and the whole door.

In one embodiment, A refrigerator comprises: a refrigerator door including a door body and a panel assembly, wherein the panel assembly comprises: a panel configured to transmit light therethrough, a back cover positioned at a rear surface of the panel, a lighting device configured to emit light toward the panel, a supporter supporting the lighting device, the support facing the back cover and configured to transfer heat generated at the lighting device to the back cover to thereby dissipate heat at the back cover, and a heat dissipation member positioned at the back cover and configured to dissipate heat transferred from the light supporter.

the light support may contact the back cover.

the heat dissipation member may be positioned between the support and the back cover.

the back cover may have a first surface facing the light supporter and an opposite second surface facing the door body, and wherein the heat dissipation member may be positioned at the second surface of the back cover.

the heat dissipation member may include a heat sink.

the heat dissipation member may include a graphite film.

the back cover may have a first surface facing the light supporter and an opposite second surface facing the door body, and wherein the heat dissipation member may be positioned at the first surface of the back cover.

the heat dissipation member may include a graphite film.

The heat dissipation member may include a chamber filled with a heat dissipation substance.

the back cover may have a first surface facing the light supporter and an opposite second surface facing the door body, and wherein the heat dissipation member may be positioned at both the first surface of the back cover and the second surface of the back cover.

the heat dissipation member may include first and second graphite films positioned at the first and second surfaces of the back cover, respectively.

the heat dissipation member may be integral to the supporter and defines a chamber.

the chamber may be partially positioned below the lighting device and may continuously extend along at least a portion of the back cover.

the chamber may include a heat dissipation substance.

the back cover may face a front surface of the door body and define a space between the back cover and the front surface of the door body, the space defining a path configured to dissipate the heat from the back cover.

the back cover may include a cover circumference portion and a cover protrusion surrounded at least partially by the cover circumference portion, and wherein a distance between the panel and the cover circumference portion of the back cover may be greater than a distance between the panel and the cover protrusion of the back cover.

the heat dissipation member may be positioned at least at the cover circumference portion of the back cover.

the panel assembly may comprise: a light guide plate positioned between the panel and the back cover, wherein the heat dissipation member is spaced apart the light guide plate in a direction that the back cover extends.

the heat dissipation member may be spaced apart from a surface of the door body that faces the heat dissipation member.

the lighting device may be positioned between a plane containing the panel and the back cover.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments will be described in detail with reference to the accompanying drawings. However, the present disclosure is limited to the embodiments in which the spirit of the present invention is proposed, and other degenerate idea or other embodiments included in the scope of the present invention may be easily proposed by addition, changes, deletions, etc. of other elements.

Prior to a description, directions are defined. In an embodiment of the present disclosure, a direction toward a door is defined as a front direction with respect to a cabinet shown in FIGS. 2 and 2, a direction toward the cabinet with respect to the door is defined as a rear direction, a direction toward a bottom on which a refrigerator is installed is defined as a downward direction, and a direction away from the bottom is defined as an upward direction.

Figure 1:
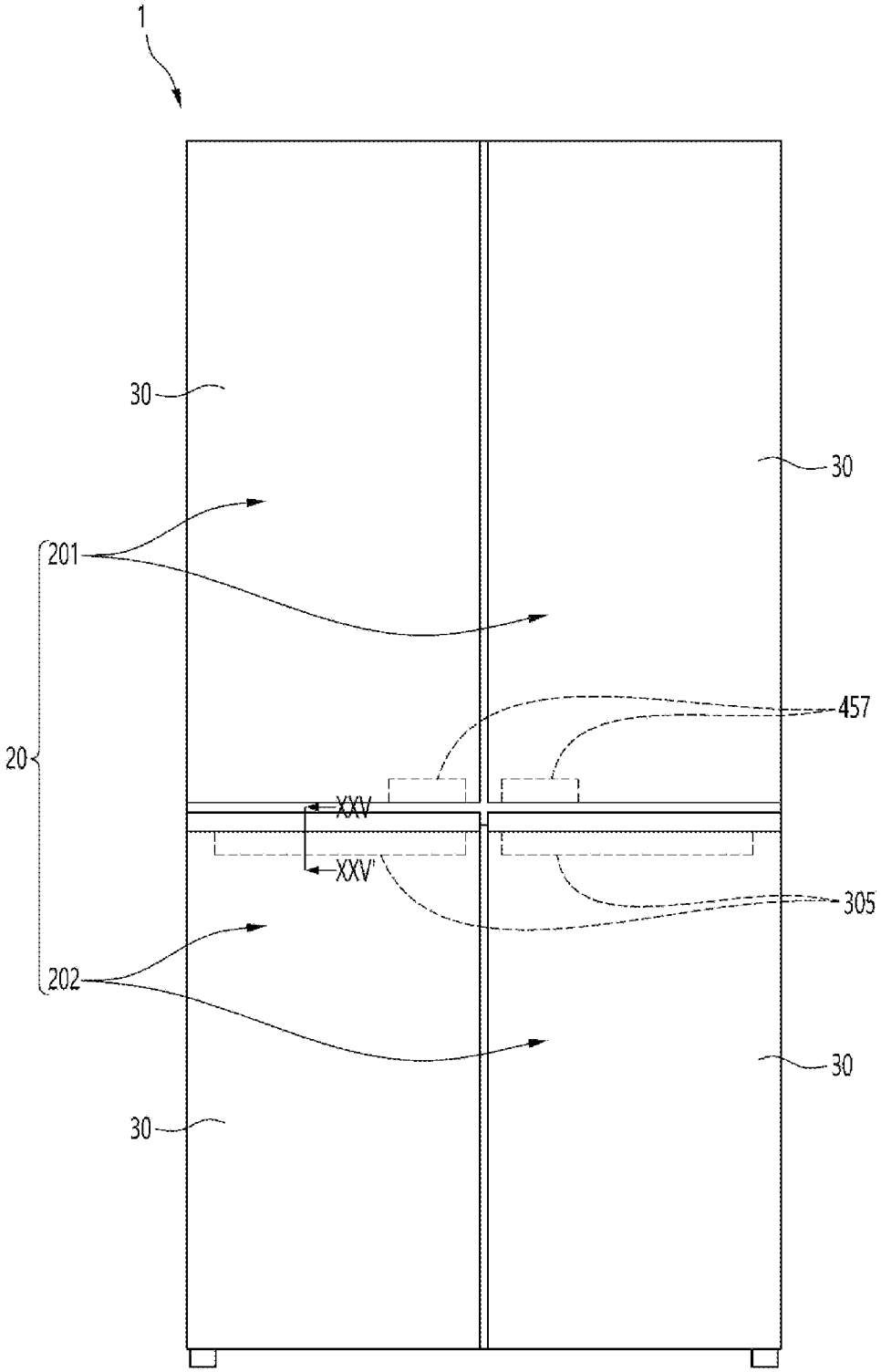
FIG. 1 is a front view of a refrigerator according to a first embodiment.
Figure 2:
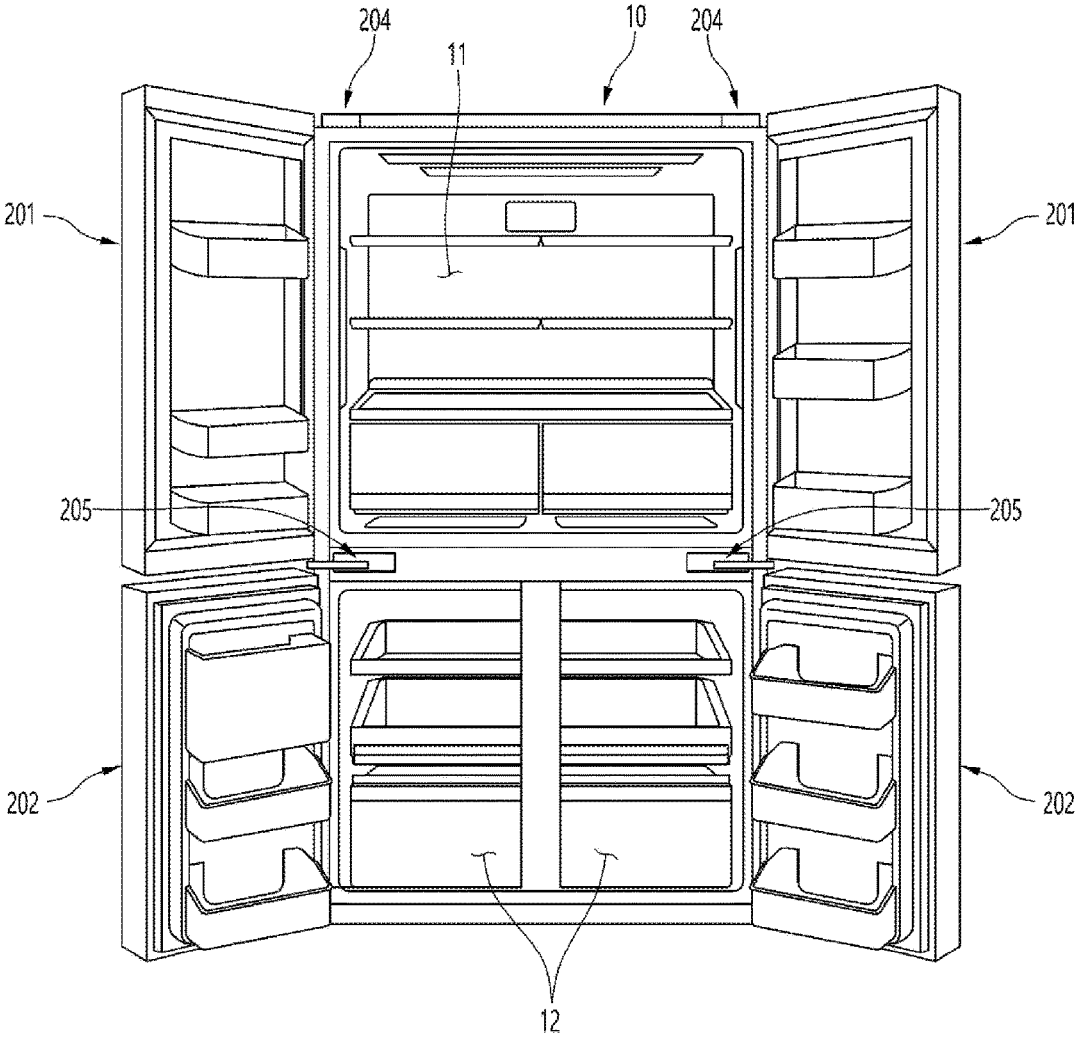
FIG. 2 is a front view illustrating a state in which a door of the refrigerator is opened.

FIG. 1 is a front view of a refrigerator according to an embodiment. Also, FIG. 2 is a front view illustrating a state in which a door of the refrigerator is opened.

As illustrated in the drawings, an outer appearance of a refrigerator 1 according to an embodiment may be defined by a cabinet 10 in which a storage space is defined, and a door 20 for opening and closing the storage space of the cabinet 10.

For example, the cabinet 10 may define the storage space partitioned in a vertical direction. Here, a refrigerating compartment 11 may be defined at an upper portion of the cabinet 10, and a freezing compartment 12 may be defined at a lower portion of the cabinet 10. The refrigerating compartment 11 may be referred to as an upper storage space, and the freezing compartment 12 may be referred to as a lower storage space.

The door 20 may be configured to open and close each of the refrigerating compartment 11 and the freezing compartment 12. For example, the door 20 may be rotatably mounted to the cabinet 10 by being connected by hinge devices 204 and 205, and each of the refrigerating compartment 11 and the freezing compartment 12 may be opened and closed by the rotation. Of course, the door 20 may also be withdrawn to open and close each of the refrigerating compartment and the freezing compartment.

The door 20 may include a refrigerating compartment door 201 that opens and closes the refrigerating compartment 11 and a freezing compartment door 202 that opens and closes the freezing compartment 12. In addition, a pair of the refrigerating compartment door 201 and the freezing compartment door 202 may be arranged side by side at both left and right sides.

Handles 457 and 350 may be disposed on the refrigerating compartment door 201 and the freezing compartment door 202, respectively. The user may open and close the refrigerator compartment door 201 and the freezer compartment door 202 by holding the handles 457 and 350.

Of course, for convenience of explanation and understanding, although the refrigerator having the structure in which the refrigerating compartment is disposed at the upper portion, and the freezing compartment is disposed at the lower portion is described as an example in the embodiment, the present disclosure may be applied to all types of refrigerators provided with the door without being limited to the opening and closing types of the refrigerator and the door. That is, the door 20 may be a sliding door 20.

An outer appearance of the front surface of the refrigerator 1 may be defined in the state in which the door 20 is closed and may define the out appearance of the refrigerator 1 viewed from the front in the state in which the refrigerator 1 is installed. In addition, at least a portion of the front surface of the door 20 may be configured to shine in a color set by the operation of the lighting device 36.

Hereinafter, the structure of the door 20 will be described in detail with reference to drawings. In addition, in an embodiment of the present disclosure will be described with reference to the refrigerator compartment door 201 disposed at the left side, and other doors may have the same structure with only a difference in mounting position.

Figure 3:
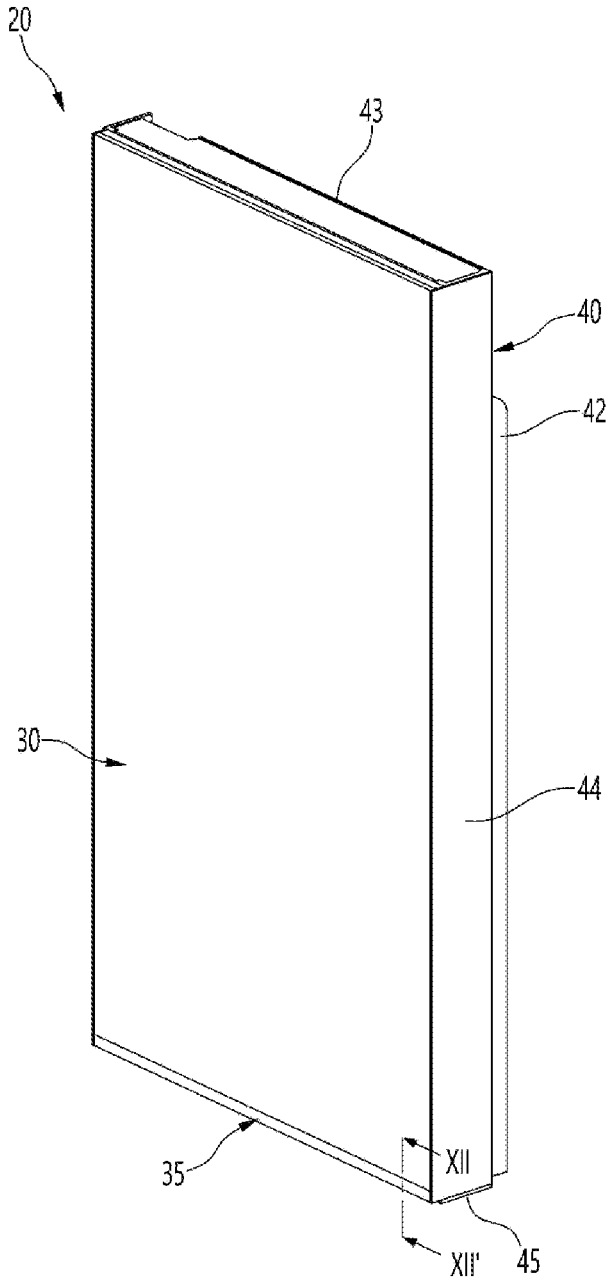
FIG. 3 is a perspective view of the door.
Figure 4:
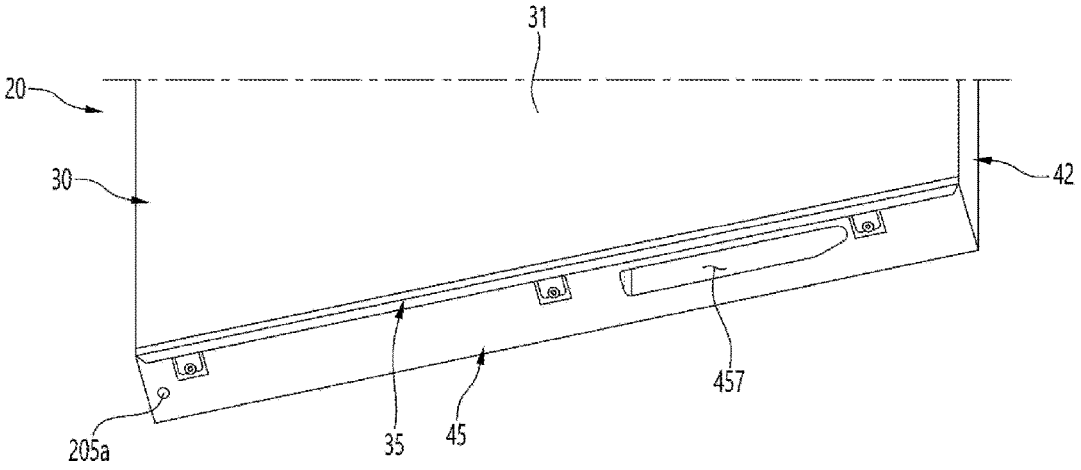
FIG. 4 is a partial perspective view of the door when viewed from the below.
Figure 5:
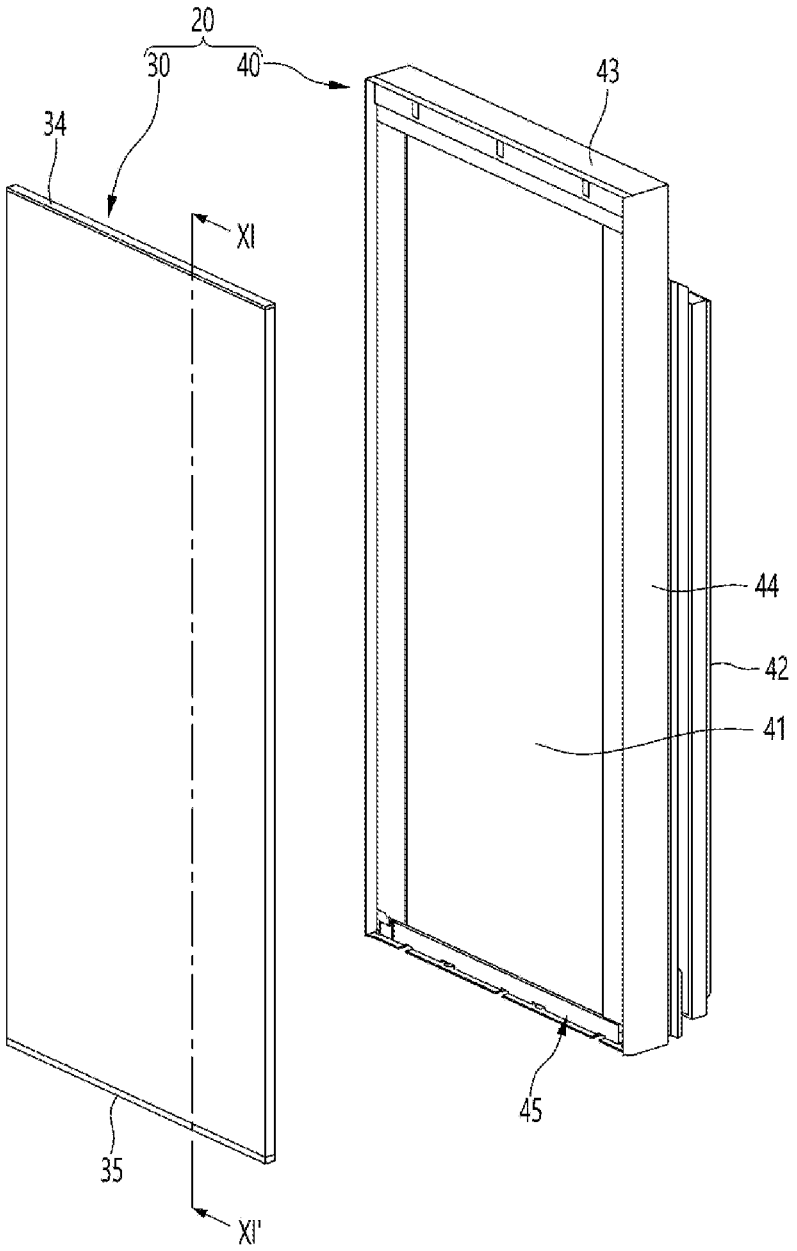
FIG. 5 is an exploded perspective view illustrating a state in which a panel assembly and a door body, which are components of the door, are separated from each other.

FIG. 3 is a perspective view of the door. Also, FIG. 4 is a partial perspective view of the door when viewed from the below. Also, FIG. 5 is an exploded perspective view illustrating a state in which a panel assembly and a door body, which are components of the door, are separated from each other.

As illustrated in the drawings, the door 20 may include a door body 21 defining the overall shape of the door 20 and configured to open and close the storage space and a panel assembly 30 defining an outer appearance of a front surface of the door 20. The door 20 may be configured so that the panel assembly 30 is mounted on a front surface of the door body 40.

The door body 40 may include a body plate 41 defining a front surface and a door liner 42 defining a rear surface. The body plate 41 may be made of a metal material and disposed to face a rear surface of the panel assembly 30.

The door body 40 may include a side decoration 44 defining right and left side surfaces of the door body 21. The side decoration 44 may connect right and left side ends of the body plate 41 and right and left side ends of the door liner 42.

The door body 40 may include an upper cap decoration 43 and a lower cap decoration 45 that form top and bottom surfaces of the door body 40. The upper cap decoration 43 may be connected to an upper end of the side decoration 44, an upper end of the body plate 41, and an upper end of the door liner 42. The lower cap decoration 45 may be connected to a lower end of the side decoration 44, a lower end of the body plate 41, and a lower end of the door liner 42. In addition, the insulator 400 may be filled inside the door body 40.

In addition, the recessed handle 457 may be disposed on a circumferential surface of the door body 40. The arrangement position of the handle 457 may be changed according to the arrangement position of the door 20, but may be recessed from any one of a top surface, a bottom surface, and a side surface of the door body 40.

For example, as illustrated in FIG. 4, the handle 457 may be disposed on the bottom surface of the door 20. The handle 457 may be recessed from the lower cap decoration 45 and may be recessed to a depth at which the user is capable of gripping a lower end of the door 20. In addition, when the door 20 is a rotatable door, the handle 457 may be disposed at one side far from a hinge hole 205*a* into which a rotation shaft of the door 20 is inserted based on a center of the door 20.

In addition, the handle 457 may have an area that at least partially overlaps the lighting device 36 and the heat dissipation member 38 to be described below when viewed from the front.

The panel assembly 30 may be provided in a plate shape and may define an outer appearance of the front surface of the door 20 while being mounted on the front surface of the door body 40. Since the panel assembly 30 may form the outer appearance of the front surface of the door 20, the panel assembly 30 may be referred to as a door panel, and since the panel assembly 30 may form the outer appearance of the front surface of the refrigerator 1, the panel assembly 30 may also be referred to as an exterior panel.

The panel assembly 30 may be detachably mounted to the door body 40 in an assembled state. Upper and lower ends of the panel assembly 30 may be fixed to the upper cap decoration 43 and the lower cap decoration 45.

Hereinafter, the structure of the panel assembly 30 will be described in more detail with reference to drawings.

Figure 6:
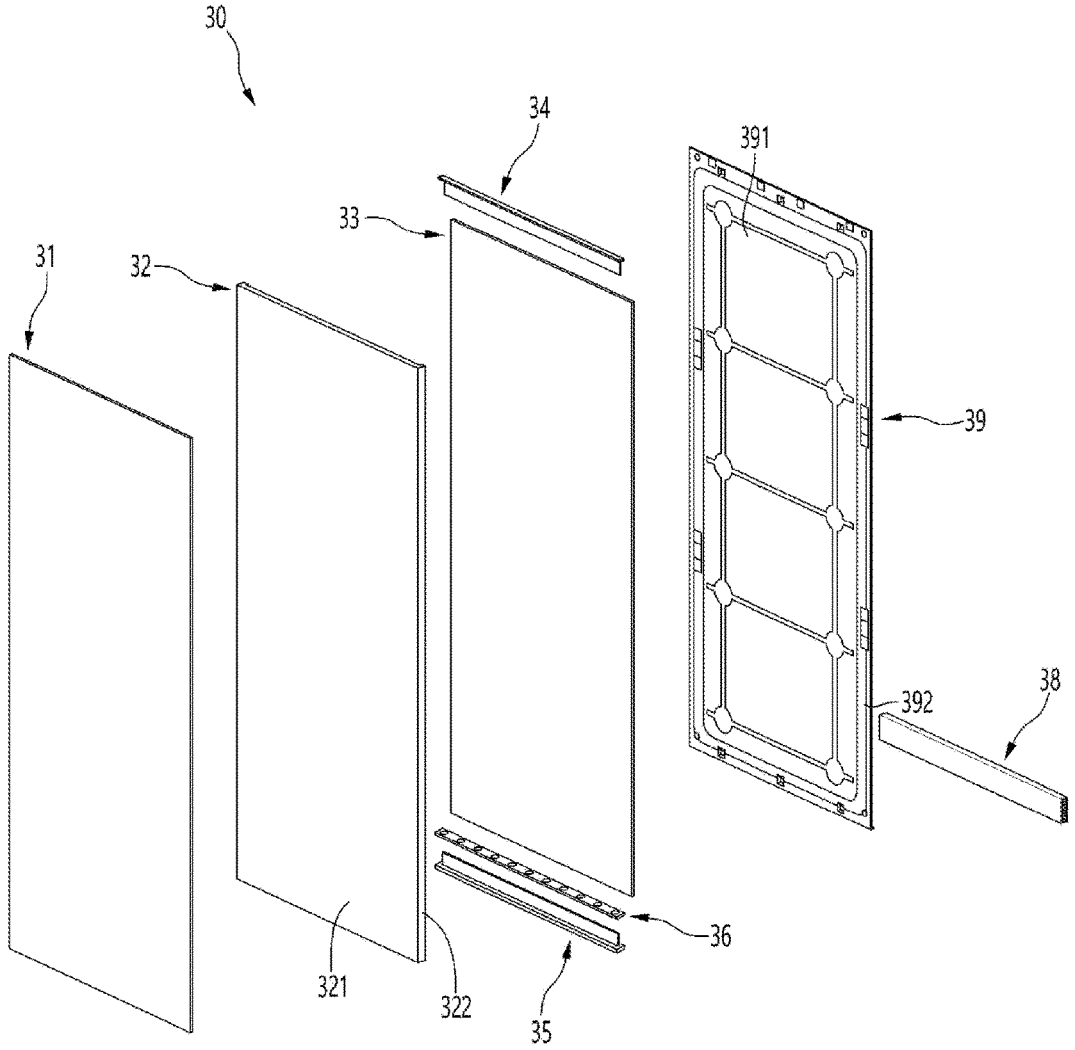
FIG. 6 is an exploded perspective view of the panel assembly.
Figure 7:
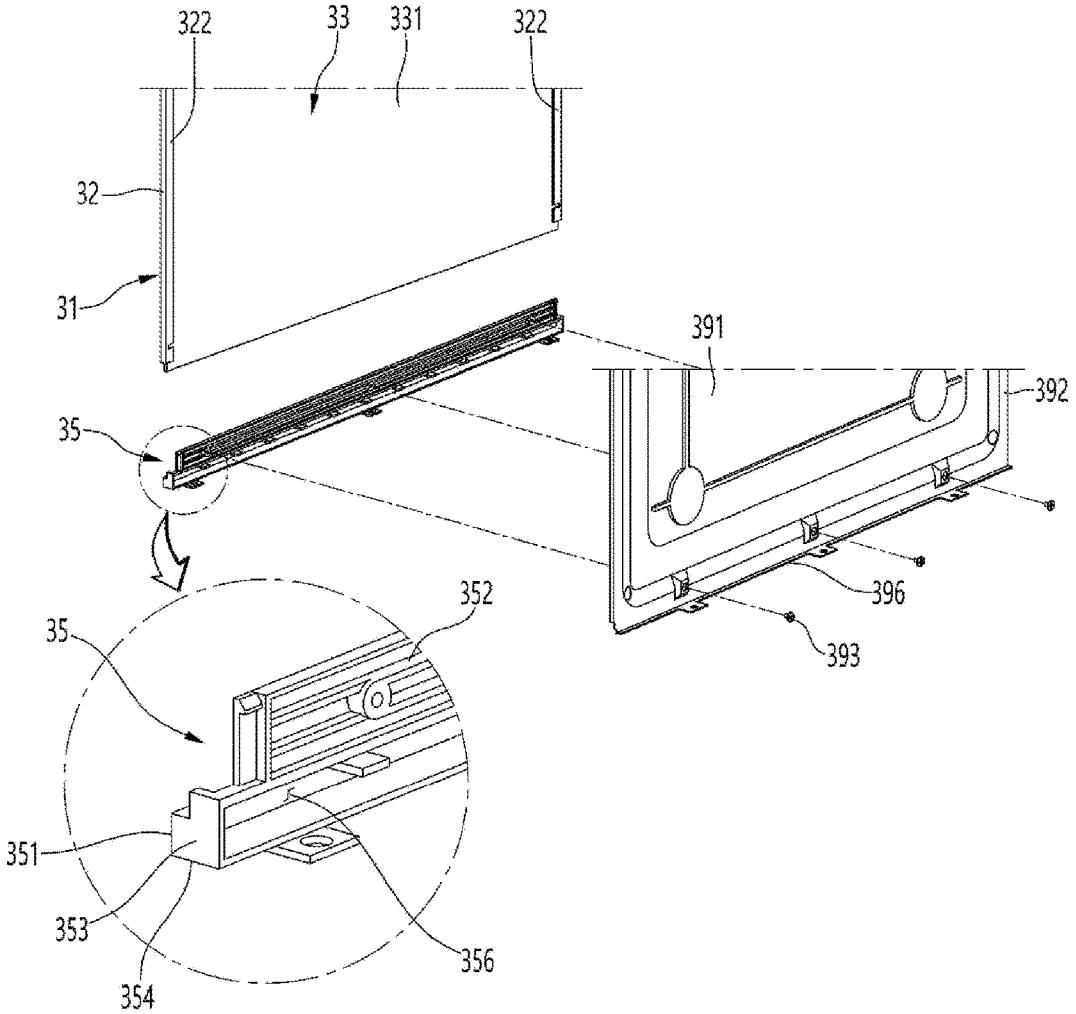
FIG. 7 is a partial exploded perspective view illustrating a state in which a lower portion of the panel assembly is separated.

FIG. 6 is an exploded perspective view of the panel assembly. Also, FIG. 7 is a partial exploded perspective view illustrating a state in which a lower portion of the panel assembly is separated.

As illustrated in the drawing, the panel assembly 30 may include a panel 31 defining an outer appearance of a front surface thereof, a lighting device 36 emitting light to the panel 31, and a back cover 39 defining a rear surface of the panel assembly 30.

In addition, the panel assembly 30 may include a light guide plate 33 that guides the light of the lighting device to the panel. The panel assembly 30 may further include a mounting member 32 that mounts the light guide plate 33 and the panel 31.

The panel assembly 30 may include an upper bracket 34 defining a top surface of the panel assembly 30 and a lower bracket 35 defining a bottom surface of the panel assembly 30. The lighting device 36 may be mounted on the lower bracket 35.

In more detail, the panel 31 may be formed in a rectangular plate shape and may be formed of a material that transmits light therethrough. In addition, the panel 31 may be mounted on the mounting member 32.

The light guide plate 33 may be disposed at a rear side spaced apart from the panel 31. In addition, the light guide plate 33 may be configured to guide the light radiated from the lighting device 36 disposed below the light guide plate 33 toward the panel 31. A reflective layer 331 that reflects the light forward may be provided on a rear surface of the light guide plate 33.

The mounting member 32 may be configured so that the light guide plate 33 and the panel 31 are fixedly mounted thereon. The mounting member 32 may include a front surface portion 321, on which the panel 31 is mounted, and a side surface portion protruding backward from each of both left and right ends of the front surface portion 321.

Both ends of the light guide plate 33 may be inserted and fixed to the side surface portions 322 on both the left and right sides, respectively. In addition, the upper bracket 34 and the lower bracket 35 may be inserted and fixed to upper and lower ends of the side surface portion, respectively. In addition, both left and right ends of the back cover 39 may be supported by the side surface portion 322.

The mounting member 32 may not be limited to such a structure, but may have a variety of different structures that are capable of being coupled to at least one of the panel 31, the light guide plate 33, the upper bracket 34, the lower bracket 35, or the back cover 39.

The lower bracket 35 may include a lower bracket front surface portion 351, a lower bracket rear surface portion 352, a lower bracket side surface portion 353, and a lower bracket bottom surface portion 354. In addition, a space in which the lighting device 36 is accommodated may be defined in the lower bracket 35.

In addition, a plurality of screws 393 may be coupled to the lower bracket rear surface portion 352 so that the back cover 39 is fixedly mounted. A bracket opening 356 may be defined in the lower bracket rear surface portion 352. The lighting device 36 may be accessible through the bracket opening 356. In addition, the bracket opening 356 may be shielded by the back cover 39.

The back cover 39 may be provided in a shape of a plate made of a metal material having excellent thermal conductivity and high strength. For example, the back cover 39 may be made of a galvanized steel sheet. The back cover 39 may include a cover protrusion 391 at a center of the back cover 39 and a cover circumference portion 392 at an edge of the back cover 39.

The cover protrusion 391 may protrude further forward than the cover circumference portion 392 and may support the light guide plate 33 at the rear side. In addition, upper and lower ends of the cover circumference portion 392 may be coupled to the upper bracket 34 and the lower bracket 35, respectively. In addition, both left and right ends of the cover circumference portion 392 may be supported by the side surface portion 322.

A cover bent portion 396 that is bent backward may be further disposed on a lower end of the back cover 39. In addition, the cover bent portion 396 may be seated in a state of overlapping a portion of the lower bracket bottom surface portion 354.

In addition, a heat dissipation member 38 may be mounted on the back cover 39.

Hereinafter, an arrangement of the lighting device 36 and the heat dissipation member 38 will be described in more detail with reference to the drawings.

Figure 8:
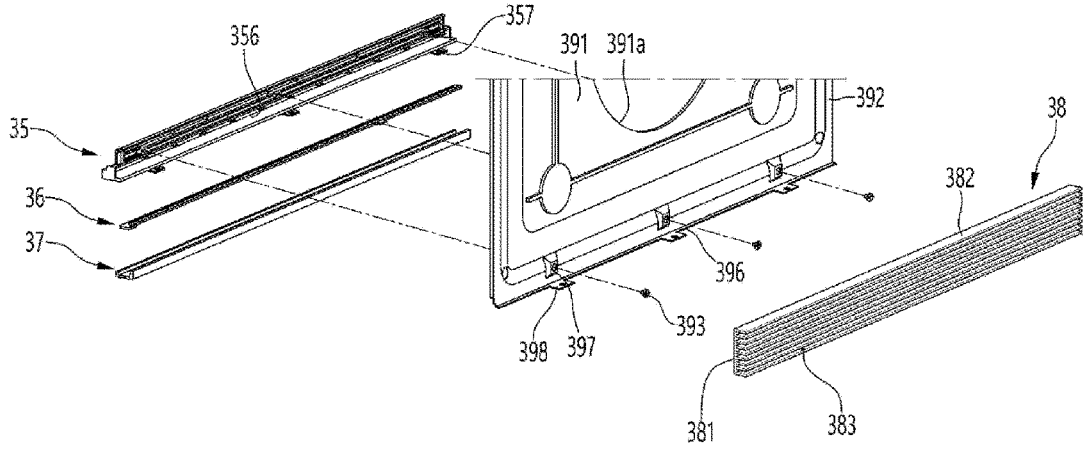
FIG. 8 is an exploded perspective view illustrating a coupling structure of a lighting device and a heat dissipation member that are components of the panel assembly.
Figure 9:
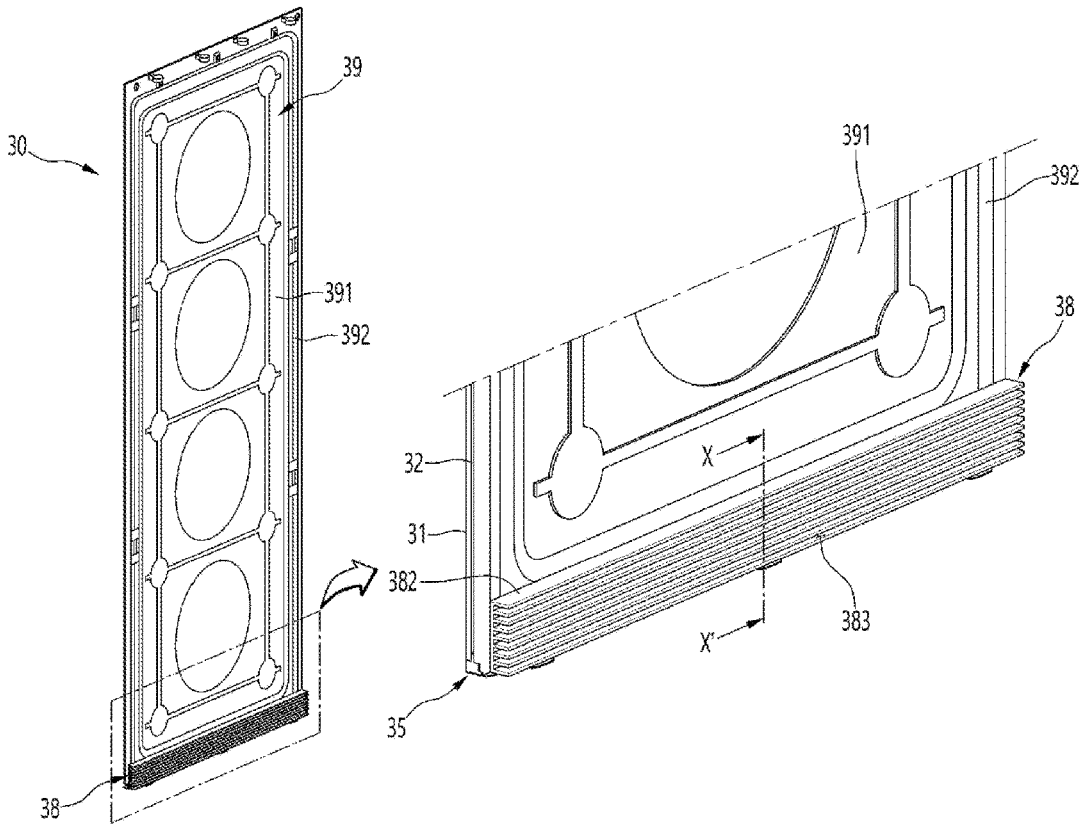
FIG. 9 is a perspective view of the panel assembly when viewed from the rear.
Figure 10:
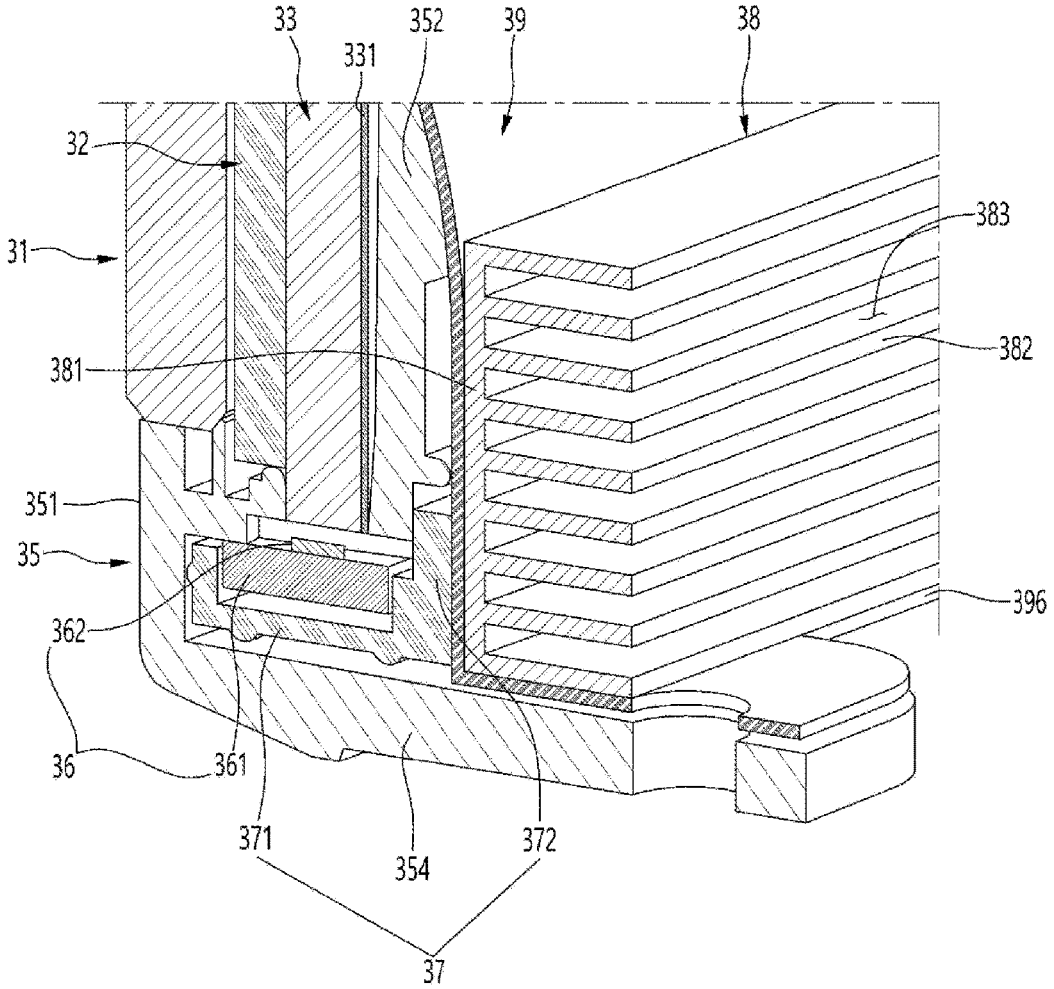
FIG. 10 is a cutaway perspective view taken along lien X-X' of FIG. 9.

FIG. 8 is an exploded perspective view illustrating a coupling structure of the lighting device and the heat dissipation member that are components of the panel assembly. Also, FIG. 9 is a perspective view of the panel assembly when viewed from the rear. Also, FIG. 10 is a cutaway perspective view taken along lien X-X' of FIG. 9.

As illustrated in the drawings, the lighting device 36 may be provided inside the lower bracket 35. The lighting device 36 may include a substrate 361 and a light source 362. The substrate 361 may extend along the lower bracket 35. In addition, a plurality of the light sources 362 may be continuously arranged at regular intervals along the substrate 361 and may radiate light toward a lower end of the light guide plate 33. The light source 362 may include, for example, an LED or an RGB LED.

A light supporter 37 may be provided under the substrate 361. The light supporter 37 may have a length corresponding to at least the lighting device 36. In addition, the light supporter 37 may be fixed in contact with an inner surface of the lower bracket 35 in a state of being inserted into the lower bracket 35.

The light supporter 37 may include a seating portion 371 and a contact portion 372. The seating portion 371 may define a bottom surface of the light supporter 37 and may be disposed below the substrate 361 to support the substrate 361. In addition, the substrate 361 may adhere to the seating portion 371 by an adhesive member.

The seating portion 371 may be maintained in a state of being in contact with the substrate 361, and thus, heat generated from the substrate 361 may be transferred to the seating portion 371. The light supporter 37 may be made of a thermally conductive material. For example, the light supporter 37 may be made of a metal material such as aluminum or copper.

The contact portion 372 may extend upward from a rear end of the seating portion 371. The contact portion 372 may extend from the lower end of the back cover 39 to the cover circumference portion 392.

In addition, the contact portion 372 may be exposed backward through the bracket opening 356 in a state of being mounted on the lower bracket 35. Thus, when the back cover 39 is mounted, a rear surface of the contact portion 372 may be in contact with a front surface of the back cover 39. In this case, the contact portion 372 and the back cover 39 may adhere to each other by the adhesive member.

When the back cover 39 is mounted, the light supporter 37 and the lighting device 36 may be fixed inside the lower bracket 35. In addition, the heat generated by the lighting device 36 may be transferred to the back cover 39 through the light supporter 37.

In addition, the heat dissipation member 38 may be provided on the rear surface of the back cover 39. The heat dissipation member 38 may be configured to more effectively dissipate the heat transmitted from the lighting device 36 and may be provided at a lower end of the back cover 39.

The heat dissipation member 38 may be made of a metal material such as aluminum. In addition, the heat dissipation member 38 may have a structure such as a heat sink for easy heat dissipation. For example, the heat dissipation member 38 may include a base 381 that is in contact with the back cover 39 and a plurality of heat dissipation fins 382 arranged at regular intervals along the base 381. In addition, a space 383 spaced apart for heat dissipation may be defined between the plurality of heat dissipation fins 382.

The base 381 may extend from a left end to a right end of the back cover 39 and may have a height that is set to be disposed on the cover circumference portion 392 of the back cover 39. That is, the heat dissipation member 38 may extend upward from the lower end of the back cover 39 and be disposed within the cover circumference portion 392 so as not to interfere with the cover protrusion 391.

In addition, the heat dissipation member 38 may be disposed at the rear side on the same extension line as the lighting device 36. Thus, the heat of the lighting device 36 may be directed to the heat dissipation member 38 in the shortest distance. In addition, the light supporter 37 may be disposed between the lighting device 36 and the heat dissipation member 38.

In addition, a front surface of the base 381, i.e., one surface of the heat dissipation member 38, which is in contact with the rear surface of the back cover 39, may be provided in a shape corresponding to the back cover 39. That is, when there is an uneven or bent portion on the rear surface of the back cover 39, the front surface of the heat dissipation member 38 may be provided in a corresponding shape, and thus, when the heat dissipation member 38 is mounted, the front surface of the heat dissipation member 38 may be completely in close contact with the rear surface of the back cover 39.

A plurality of the heat dissipation fins 382 may extend from a left end to a right end of the base 381 to protrude backward. The heat dissipation fins 382 may be provided in a thin plate shape and may be continuously vertically disposed at regular intervals. The heat dissipation fin 382 may protrude toward the body plate 41. Here, when the panel assembly 30 is mounted, the heat dissipation fin 382 may protrude up to a position at which the heat dissipation fin 382 does not interfere with the body plate 41.

The heat dissipation member 38 may adhere to the rear surface of the back cover 39. In addition, a front surface of the heat dissipation member 38 may be in contact with the rear surface of the back cover 39, and a bottom surface of the heat dissipation member 38 may be seated to be in contact with the cover bent portion 396. Thus, even if the door is repeatedly opened or closed, or a strong impact is generated during the opening and closing, the heat dissipation member 38 may be maintained in the state of being mounted on the panel assembly 30. In addition, the panel assembly 30 may be attached to or detached from the door body 40 in the state in which the heat dissipation member 38 is mounted.

Hereinafter, an operation of the refrigerator having the above-described structure will be described in more detail with reference to the accompanying drawings.

Figure 11:
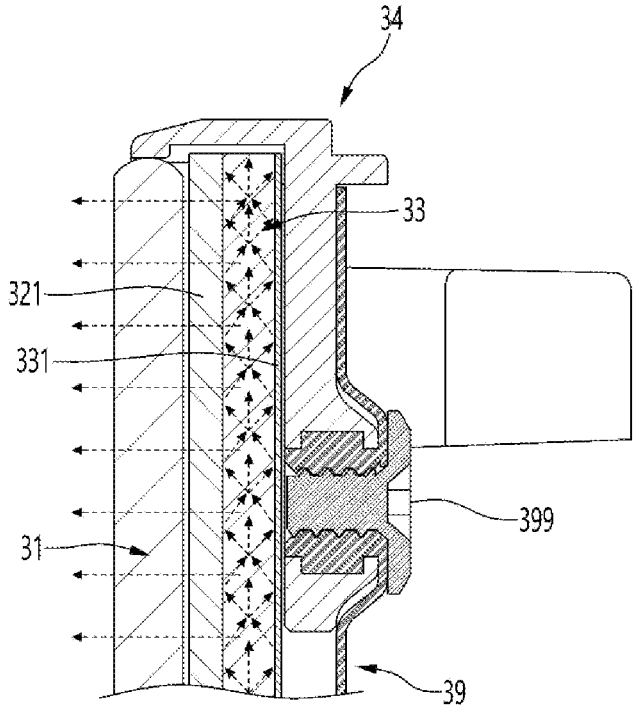
FIG. 11 is a cross-sectional view illustrating an emission state of the panel assembly.
Figure 11:
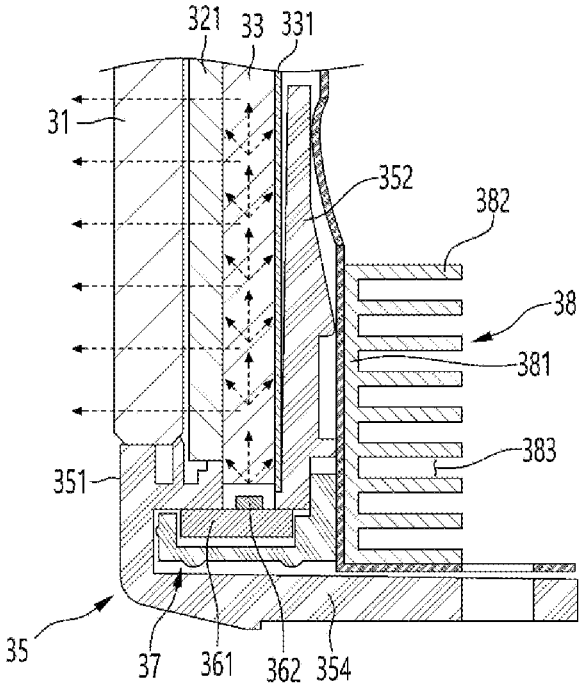

FIG. 11 is a cross-sectional view illustrating an emission state of the panel assembly.

As illustrated in the drawing, an outer appearance of a home appliance such as the refrigerator 1 according to an embodiment may be defined by the panel assembly 30, and also, a color of the outer appearance of the home appliance may be changed to a color that is set by the user according to the operation of the lighting device 36.

When the lighting device 36 is turned on, light radiated from the LED 362 may be diffused and reflected while moving upward along the light guide plate 33. In this case, the light guided by the light guide plate 33 may be reflected forward by the reflective layer 331 to pass through the panel 31 so as to be transmitted to the outside.

Of course, in an embodiment of the present disclosure, an arrangement of an edge type light source, in which the light sources 362 are arranged along one end with respect to the panel 31, is described, but the embodiment of the present disclosure is not limited thereto. An arrangement of a direct type light source, in which a plurality of light sources are disposed side by side with the panel, may be provided at the rear side of the panel 31.

The entire surface of the panel 31 may be illuminated by the lighting device 36, and most of the front surface of the door 20 may be illuminated. Thus, since the lighting device 36 requires the plurality of light sources 362, the heat generated by the light sources 362 may be inevitable. In addition, heat is generated even when the light source 362 is turned on for a long time to maintain the color of the panel 31.

The heat generated during the operation of the lighting device 36 may be transferred and dissipated by the heat dissipation member 38.

Hereinafter, the thermal transfer and heat dissipation when the lighting device 36 operates will be described in more detail with reference to the accompanying drawings.

Figure 12:
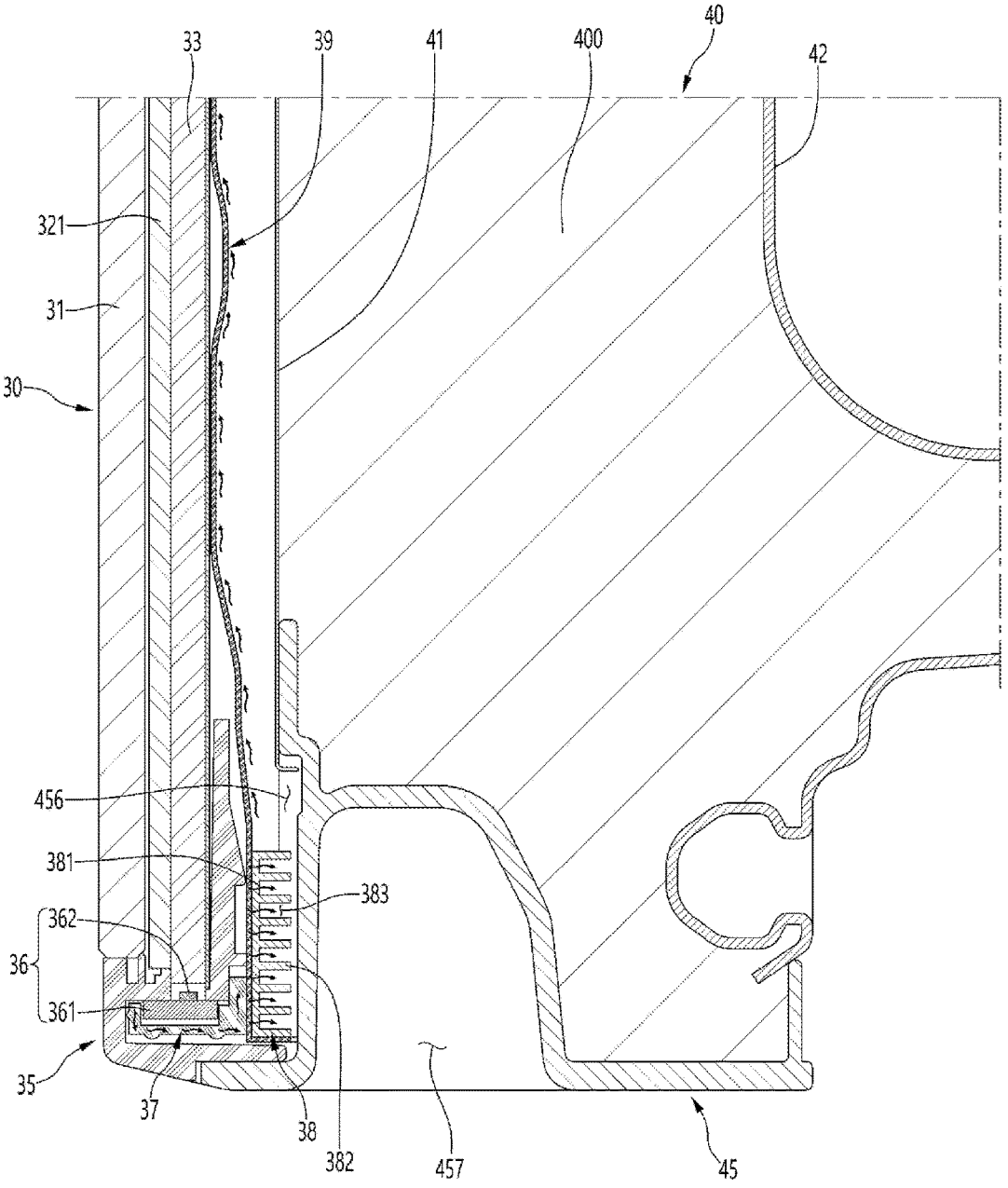
FIG. 12 is a cross-sectional view illustrating a path through which heat of the lighting device is transferred.

FIG. 12 is a cross-sectional view illustrating a path through which heat of the lighting device is transferred and is a cutaway perspective view taken along line XII-XII' of FIG. 3.

As illustrated in the drawings, when the lighting device 36 operates, the heat generated by the lighting device 36 heats a lower portion of the panel assembly 30. Particularly, a lower end of a front surface of the panel 31 adjacent to the lighting device 36 may be heated.

In addition, when the user manipulates the door 20 to open the door 20, the user puts his or her hand into the handle 457 to open the door 20. Here, the user's hand may be in contact with a lower end of the door 20 or be in contact with the lower front end of the panel 31 while gripping the lower end of the door 20.

However, the heat generated by the lighting device 36 may be transferred backward and then dissipated through the light supporter 37, the back cover 39, and the heat dissipation member 38. Particularly, the heat generated by the lighting device 36 is directed toward the light supporter 37 having high thermal conductivity to prevent the heat from being transferred toward the panel 31. In addition, the heat transferred by the back cover 39 and the heat dissipation member 38 may be radiated into a space 456 between the rear surface of the panel assembly 30 and the front surface of the door body 40. The space 456 may be defined in at least an area corresponding to an area on which the heat dissipation member 38 is disposed to minimize the heat transfer toward the body 40.

Thus, the heat generation at the lower front end of the door 20 and the bottom surface of the door 20 may be minimized. That is, even when the user puts the his or her hand into the handle 457 to manipulate the handle 457 so as to open the door 20, the user may not feel overheating on the outer surface of the door 20 by the lighting device 36.

In detail, the heat generated by the operation of the lighting device 36 may be transferred to the light supporter 37. The light supporter 37 may be made of a thermally conductive material, and thus, the heat of the lighting device 36 may be transferred by conduction.

In addition, in the state in which the light supporter 37 may be in contact with the back cover 39, the heat of the lighting device 36 may be transferred to the back cover 39 through the seating portion 371 and the contact portion 372. Since the back cover 39 is also made of a thermally conductive material, the heat transferred from the light supporter 37 may flow upward along the back cover 39 and be dissipated through the entire back cover 39.

In addition, the heat dissipation member 38 may dissipate the heat of the back cover 39 adjacent to the lighting device 36. Here, the heat dissipation member 38 may also be disposed in the space 456, and thus, the heat radiated from the heat dissipation member 38 may be effectively radiated in the space 456.

Since the light supporter 37 and the back cover 39 are in contact with the heat dissipation member 38 and have a function of transferring and dissipating the heat of the lighting device 36, the light supporter 37, the back cover 39, and the heat dissipation member 38 may be referred to as a heat dissipation member. In addition, the heat dissipation member 38 may be referred to as a heat transfer member.

The heat radiated from the back cover 39 and the heat dissipation member 38 may be transferred upward in the space 456 so as to be away from the handle 457. Thus, even when the user holds the handle 457, the user may not feel the heat from the handle 457.

Due to such a heat dissipation structure, the lighting device 36 may not be overheated even during the long-term operation. Also, even if the lighting device operates for a long time, reliable operation may be secured without being damaged.

There may be various other embodiments other than the aforementioned embodiments. In another embodiment of the present disclosure, the heat dissipation member may be provided in the plate-shaped sheet and be attached to the back cover. In another embodiment of the present disclosure, other constitutes except for a heat dissipation member have the same structure as those in the foregoing embodiment, and thus, the same reference numerals are used for the same constitute, and detailed descriptions thereof will be omitted. In addition, reference numerals that are not described or reference numerals that are not shown have the same configuration as the same reference numerals in the foregoing embodiment, and descriptions thereof will be omitted.

Hereinafter, a second embodiment of the present disclosure will be described with reference drawings.

Figure 13:
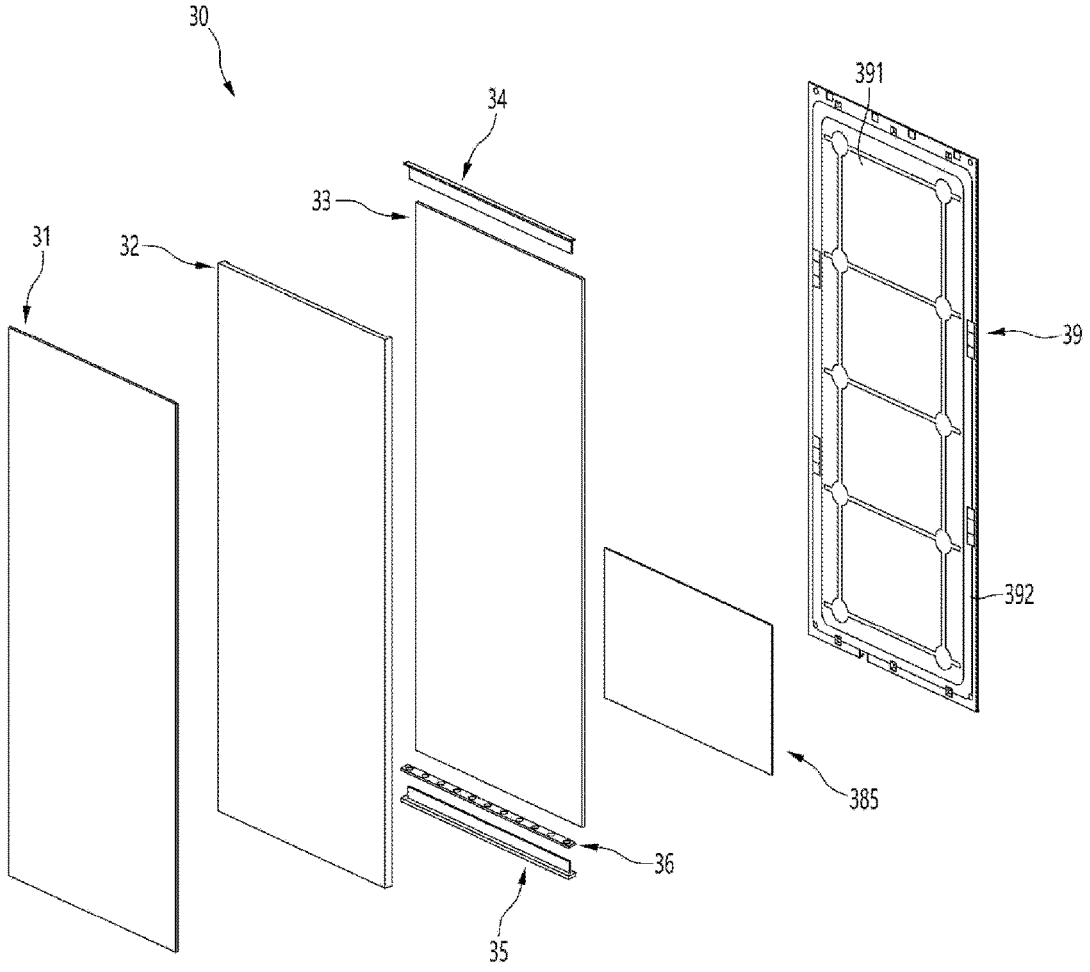
FIG. 13 is an exploded perspective view of a panel assembly according to a second embodiment.
Figure 14:
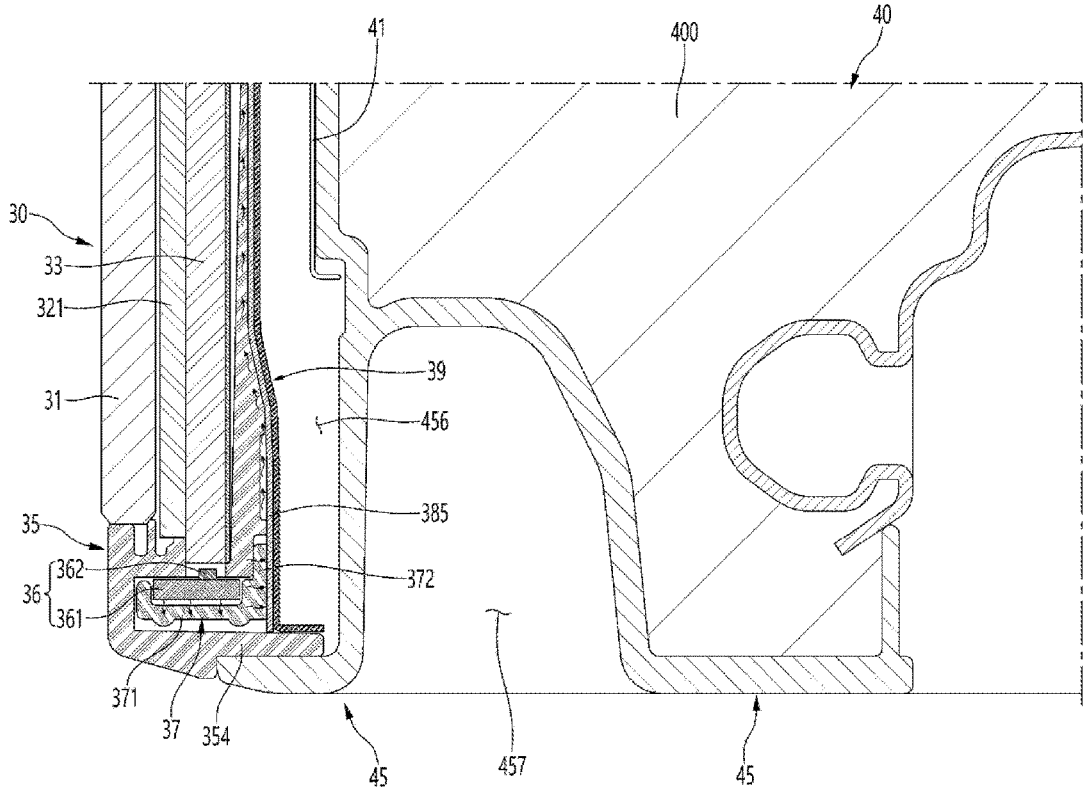
FIG. 14 is a cross-sectional view illustrating a path through which heat of a lighting device that is one component of the panel assembly is transferred.

FIG. 13 is an exploded perspective view of a panel assembly according to a second embodiment. Also, FIG. 14 is a cross-sectional view illustrating a path through which heat of a lighting device that is one component of the panel assembly is transferred.

As illustrated in the drawings, a panel assembly 30 of a refrigerator 1 according to the second embodiment may be mounted on a door body 40.

The panel assembly 30 includes a panel 31 defining an outer appearance of a front surface thereof, a back cover 39 defining an outer appearance of a rear surface thereof, a lighting device 36 emitting light to the panel 31, and a heat dissipation member 385.

In addition, the panel assembly 30 may further include a light guide plate 33 disposed behind the panel 31 to guide the light emitted from the lighting device 36 to the panel 39. In addition, the panel assembly 30 may further include a mounting member 32. The mounting member 32 may be provided between the panel 31 and the light guide plate 33, and the panel 31 and the light guide plate 33 may be mounted on the mounting member 32. In addition, the panel assembly 30 may include an upper bracket 34 defining a top surface and a lower bracket 35 defining a bottom surface.

The lighting device 36 and a light supporter 37 that mounts the lighting device 36 may be provided inside the lower bracket 35. The light supporter 37 may be configured to support the lighting device 36 and conduct heat of the lighting device 36 and may be made of a heat conductive material. The heat dissipation member 385 may be provided between the light guide plate 33 and the back cover 39.

The heat dissipation member 385 may be configured to induce heat dissipation of the lighting device 36 and may be made of a material having excellent thermal conductivity. In addition, the heat dissipation member 385 may be provided in a plate-shaped sheet structure so as to be in surface contact with the light supporter 37 and the back cover 39.

For example, the heat dissipation member 385 may be made of a graphite sheet. The graphite sheet may be configured to include an additive for improving the thermal conductivity and may be processed into a sheet shape. Of course, if the heat dissipation member 385 is provided in a sheet shape that is in close contact with the back cover 39 to transfer heat, the heat dissipation member 385 may be made of various materials including a metal material.

The heat dissipation member 385 may have a size corresponding to a width of the back cover 39. That is, the heat dissipation member 385 may extend from a left end to a right end of the back cover 39. In addition, the heat dissipation member 385 may extend from the lower end of the back cover 39 to a position passing at least a cover circumference portion 392 to provide an area capable of having sufficient heat capacity. In addition, the heat dissipation member 385 may extend to a position higher than the handle 457 so that heat transferred from the lighting device 36 is transferred upward higher than the handle 457.

The heat dissipation member 385 may shield a rear surface of the lower bracket 35, and in particular, may be in surface contact with a contact portion 372 of the light supporter 37 mounted on the lower bracket 35. Thus, when the panel assembly 30 is assembled, the heat of the lighting device 36 may be transferred to the heat dissipation member 385, and the heat from the heat dissipation member 385 may be transferred to the back cover 39 and then be dissipated. Since the heat dissipation member 385 transfer heat, the heat dissipation member 385 may be referred to as a heat transfer member.

The heat dissipation member 385 may be provided in a sheet shape to be in close contact with a front surface of the back cover 39. In this case, the heat dissipation member 385 may be made of a deformable material and may be fixed in a deformed state to a corresponding shape so as to be in close contact with the back cover 39. Of course, if necessary, the heat dissipation member 385 may be made of a non-deformable material, and the heat dissipation member 385 may be provided in a shape corresponding to the front shape of the back cover 39.

In addition, the heat dissipation member 385 may be disposed at a rear side of the lighting device 36 on the same extension line. At least a portion of the lighting device 36 may be disposed in a region between upper and lower ends of the heat dissipation member 385. Thus, the heat of the lighting device 36 may not be induced to the other side, and the heat may be dissipated after being transferred to the back cover 39 through the light supporter 37 and the heat dissipation member 385 by the shortest distance.

That is, a contact portion 372 of the light supporter 37 may be in close contact with a front surface of the heat dissipation member 385 with respect to the heat dissipation member 385, and a rear surface of the heat dissipation member 385 may be in close contact with the front surface of the back cover 39. Thus, the heat of the lighting device 36 may pass through the light supporter 37 and be transferred to the heat dissipation member 385 and then be transferred upward along the heat dissipation member 385 so as to be dissipated through the back cover 39 that is in contact with the heat dissipation member 385. In addition, the heat transferred to the back cover 39 may be radiated into space 456.

There may be various other embodiments other than the aforementioned embodiments. In another embodiment of the present disclosure, the heat dissipation member may be provided in the plate-shaped sheet and be attached to both surfaces of the back cover. In another embodiment of the present disclosure, other constitutes except for a heat dissipation member have the same structure as those in at least one foregoing embodiment, and thus, the same reference numerals are used for the same constitute, and detailed descriptions thereof will be omitted. In addition, reference numerals that are not described or reference numerals that are not shown have the same configuration as the same reference numerals in the foregoing embodiment, and descriptions thereof will be omitted.

Hereinafter, a third embodiment of the present disclosure will be described with reference drawings.

Figure 15:
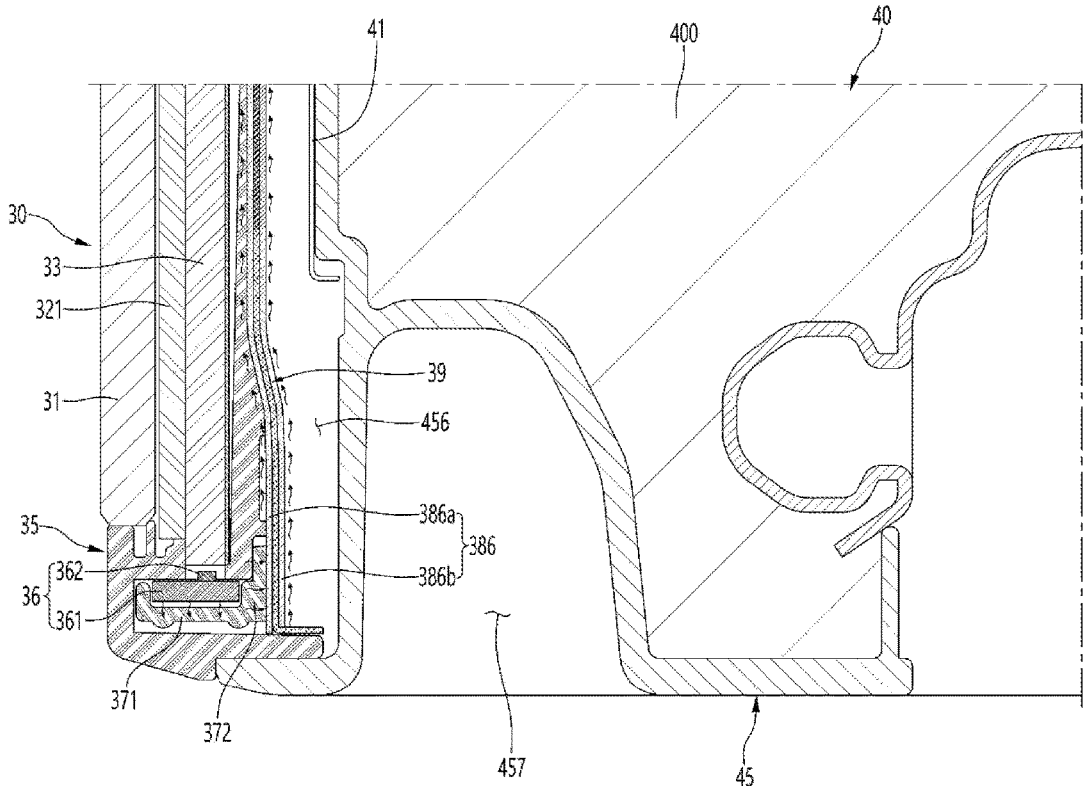
FIG. 15 is a cross-sectional view illustrating a path through which heat of a lighting device that is one component of a panel assembly is transferred according to a third embodiment.

FIG. 15 is a cross-sectional view illustrating a path through which heat of a lighting device that is one component of a panel assembly is transferred according to a third embodiment.

As illustrated in the drawings, a panel assembly 30 of a refrigerator 1 according to the third embodiment may include a lighting device 36 of which a front surface is defined by a panel 31, and a rear surface is defined by a back cover 39 and which is disposed between the panel 31 and the back cover 39.

In addition, a light guide plate 33 may be provided behind the panel 31. A mounting member 32 is provided between the panel 31 and the light guide plate 33 to mount the panel 31 and the light guide plate 33. In addition, the panel assembly 30 may include an upper bracket 34 defining a top surface and a lower bracket 35 defining a bottom surface. The lighting device 36 that emits light to the light guide plate 33 may be provided inside the lower bracket 35. In addition, the lighting device 36 may be supported by a light supporter 37.

A heat dissipation member 386 may be provided on the back cover 39. The heat dissipation member 386 may include a first heat dissipation member 386*a* provided on a front surface of the back cover 39 and a second heat dissipation member 386*b* provided at a rear surface of the back cover 39.

Each of both the first heat dissipation member 386*a* and the second heat dissipation member 386*b* may be provided in a plate-like sheet shape and may be made of a material having high thermal conductivity. For example, each of the first heat dissipation member 386*a* and the second heat dissipation member 386*b* may be made of a graphite sheet. In addition, each of the first heat dissipation member 386*a* and the second heat dissipation member 386*b* may be made of a material having superior thermal conductivity than the back cover 39.

The first heat dissipation member 386*a* may be provided on an inner surface of the panel assembly 30 and be in contact with the contact portion 372 of the light supporter 37. Thus, the heat transferred to the light supporter 37 through the lighting device 36 may be transferred upward along the first heat dissipation member 386*a*. In addition, the first heat dissipation member 396*a* may be in contact with the back cover 39, and the heat of the first heat dissipation member 386*a* may be transferred to the back cover 39.

The second heat dissipation member 386*b* may be provided on an outer surface of the panel assembly 30 and be in contact with the rear surface of the back cover 39. Thus, the heat induced to the back cover 39 may be transferred upward again along the second heat dissipation member 386*b*.

In addition, the heat transferred to the second heat dissipation member 386*b* and the back cover 39 may be radiated into a space 456 spaced between the back cover 39 and a front surface of the door body 40.

The first heat dissipation member 386*a* and the second heat dissipation member 386*b* may have the same size and shape and may be disposed at positions facing each other. In addition, the first heat dissipation member 386*a* and the second heat dissipation member 386*b* may extend upward from a lower end of the panel assembly 30.

In addition, the first heat dissipation member 386*a* and the second heat dissipation member 386*b* may be provided on both the front and rear surfaces of the back cover, and thus, sufficient heat capacity in which the heat of the lighting device 36 is effectively conducted may be provided.

In addition, the heat dissipation member 386 may extend upward along the back cover 39 to a position higher than a handle 457. Thus, the heat generated by the lighting device 36 may be transferred and radiated to the back cover 39 above the handle 457 through the heat dissipation member 386.

Therefore, even when the user touches a front surface of the door 20 or the handle 457, the transfer of the heat of the lighting device 36 to the user may be minimized. In addition, when the door 20 is opened or closed by holding the handle 457 of the door 20, inconvenience due to the transfer of the heat to the user may be prevented from occurring.

There may be various other embodiments other than the aforementioned embodiments. In another embodiment of the present disclosure, the heat dissipation members may be provided in a sheet shape and a heat sink shape, respectively, and may be disposed on the back cover. In another embodiment of the present disclosure, other constitutes except for a heat dissipation member have the same structure as those in at least one foregoing embodiment, and thus, the same reference numerals are used for the same constitute, and detailed descriptions thereof will be omitted. In addition, reference numerals that are not described or reference numerals that are not shown have the same configuration as the same reference numerals in the foregoing embodiment, and descriptions thereof will be omitted.

Hereinafter, a fourth embodiment of the present disclosure will be described with reference drawings.

Figure 16:
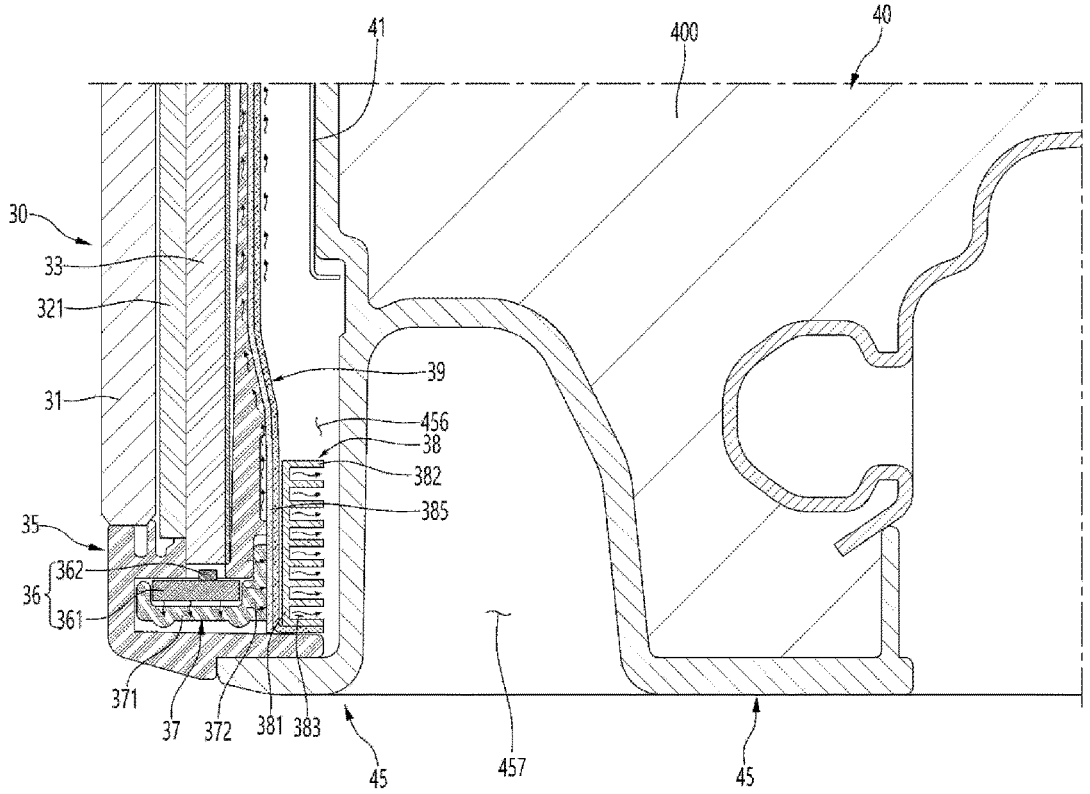
FIG. 16 is a cross-sectional view illustrating a path through which heat of a lighting device that is one component of a panel assembly is transferred according to a fourth embodiment.

FIG. 16 is a cross-sectional view illustrating a path through which heat of a lighting device that is one component of a panel assembly is transferred according to a fourth embodiment.

As illustrated in the drawings, a panel assembly 30 of a refrigerator 1 according to a fourth embodiment includes a panel 31 defining a front surface, a back cover 39 defining a rear surface, a lighting device 36 provided between the panel 31 and the back cover 39, and heat dissipation members 385 and 38 that dissipate heat of the lighting device 36.

In addition, a light guide plate 33 may be provided behind the panel 31. A mounting member 32 is provided between the panel 31 and the light guide plate 33 to mount the panel 31 and the light guide plate 33. In addition, the panel assembly 30 may include an upper bracket 34 defining a top surface and a lower bracket 35 defining a bottom surface. The lighting device 36 that emits light to the light guide plate 33 may be provided inside the lower bracket 35. In addition, the lighting device 36 may be supported by a light supporter 37.

A heat dissipation members 385 and 38 may be provided on the back cover 39. The heat dissipation members 385 and 38 may be provided on front and rear surfaces of the back cover 39, respectively, and different types of heat dissipation members 385 and 38 may be disposed, respectively.

In detail, the heat dissipation member 385 may be made of a plate-shaped material having high thermal conductivity and may be provided on the front surface of the back cover 39. For example, the heat dissipation member 385 may be made of a graphite sheet 385, and a specific structure and shape thereof may be the same as those in the foregoing embodiment.

The graphite sheet 385 may be in contact with the light supporter 37. Thus, the heat of the lighting device 36 may be transferred to the graphite sheet 385 through the light supporter 37.

The heat dissipation member 38 may be provided on the rear surface of the back cover 39. The heat dissipation member 38 may have the same structure as a heat sink 38. The heat sink 38 may include a base 381 that is in contact with the rear surface of the back cover 39 and a heat dissipation fin 382 extending along the base 381. Thus, the heat transferred to the back cover 39 may be radiated into the space 456 through the heat dissipation fin 382.

In detail, the heat generated during an operation of the lighting device 36 may be transferred to the light supporter 37. In addition, the heat of the light supporter 37 may be transferred to the graphite sheet 385 that is in contact with the contact portion 372 and may be transferred upward along the graphite sheet 385. In addition, the heat of the graphite sheet 385 may be transferred to the back cover 39.

In addition, the heat of the graphite sheet 385 provided in the back cover 39 may be dissipated through the back cover 39 while being transferred along the rear surface of the back cover 39. In addition, heat of a lower end of the back cover 39 adjacent to the lighting device may be effectively dissipated by the heat sink 38.

In this way, the different heat dissipation members 385 and 38 may be disposed inside and outside the panel assembly to effectively transfer and dissipate the heat generated in the lighting device 36.

Particularly, the graphite sheet 385 may extend upward to a position higher than the handle 457. Thus, the heat generated by the lighting device 36 may be transferred up to one side of the back cover 39 above the handle 457 through the graphite sheet 385. In addition, the heat sink 38 may be disposed close to the lighting device to dissipate the heat of the lower end of the back cover 39, which has a relatively higher temperature, to the space 456.

Therefore, even when the user touches a front surface of the door 20 or the handle 457, the transfer of the heat of the lighting device 36 to the user may be minimized. That is, when the door 20 is opened and closed by holding the handle 457, the user may not feel the heat.

There may be various other embodiments other than the aforementioned embodiments. In another embodiment of the present disclosure, a chamber filled with a thermally conductive working fluid is provided inside a heat dissipation member. In another embodiment of the present disclosure, other constitutes except for a heat dissipation member and the back cover have the same structure as those in at least one foregoing embodiment, and thus, the same reference numerals are used for the same constitute, and detailed descriptions thereof will be omitted. In addition, reference numerals that are not described or reference numerals that are not shown have the same configuration as the same reference numerals in the foregoing embodiment, and descriptions thereof will be omitted.

Hereinafter, a fifth embodiment of the present disclosure will be described with reference drawings.

Figure 17:
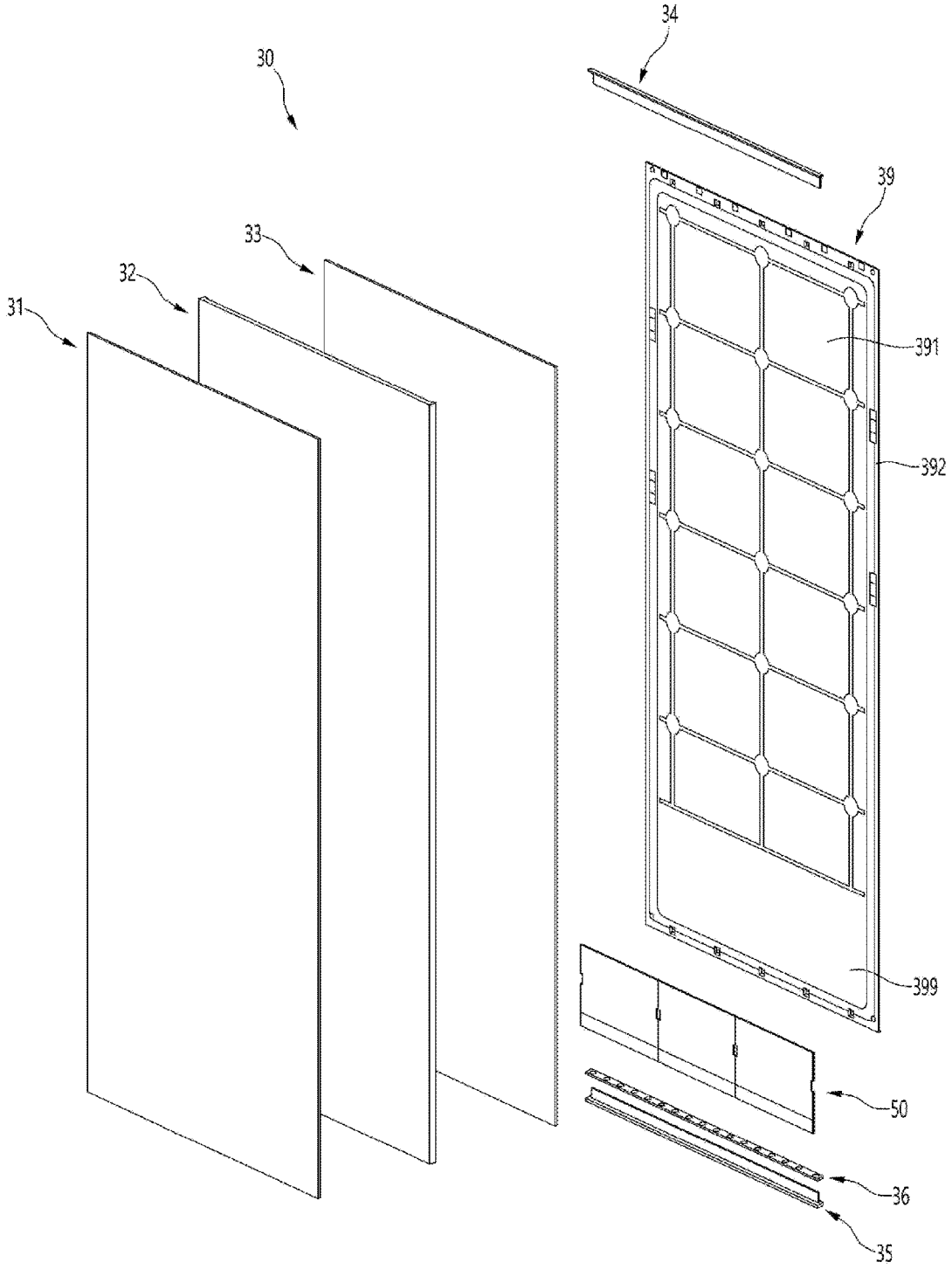
FIG. 17 is an exploded perspective view of a panel assembly according to a fifth embodiment.
Figure 18:
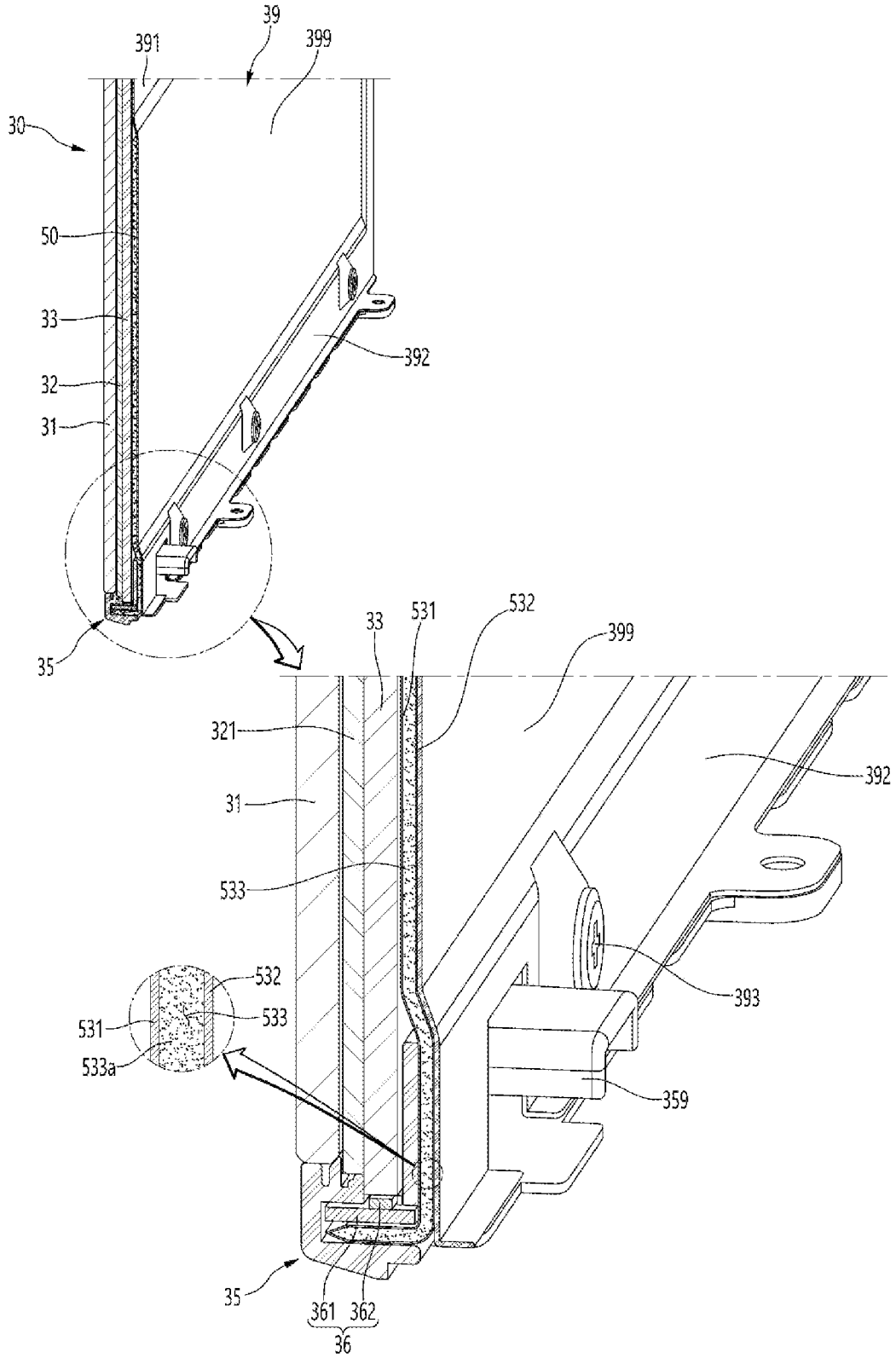
FIG. 18 is a cutaway perspective view of the panel assembly.
Figure 19:
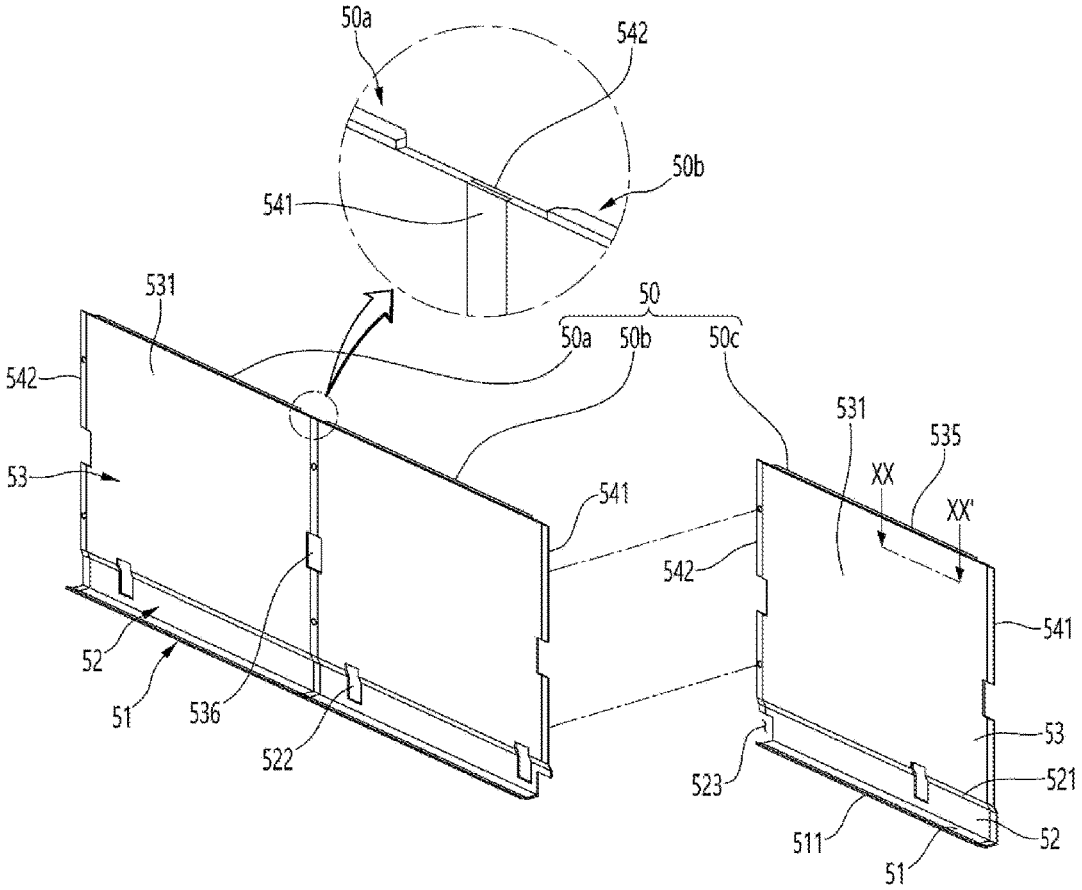
FIG. 19 is an exploded perspective view of a heat dissipation member that is one component of the panel assembly.
Figure 20:
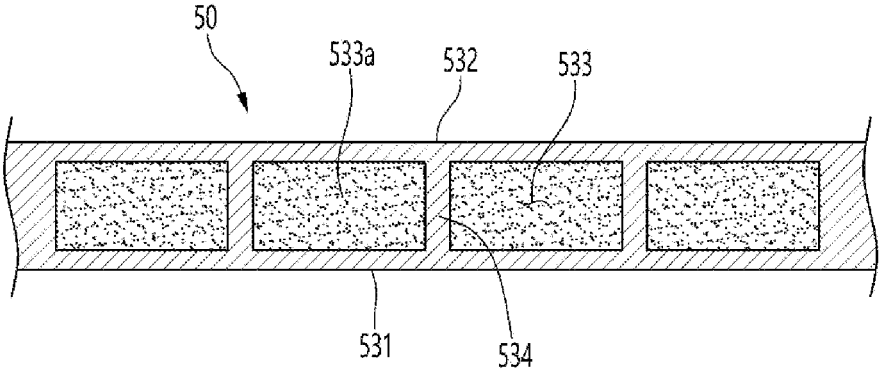
FIG. 20 is a cross-sectional view taken along line XX-XX' of FIG. 19.

FIG. 17 is an exploded perspective view of a panel assembly according to a fifth embodiment. Also, FIG. 18 is a cutaway perspective view of the panel assembly. Also, FIG. 19 is an exploded perspective view of a heat dissipation member that is one component of the panel assembly. Also, FIG. 20 is a cross-sectional view taken along line XX-XX' of FIG. 19.

As illustrated in the drawings, a panel assembly 30 of a refrigerator 1 according to the second embodiment may be mounted on a door body 40.

The panel assembly 30 includes a panel 31 defining an outer appearance of a front surface thereof, a back cover 39 defining an outer appearance of a rear surface thereof, a lighting device 36 that emits light to the panel 31, and a heat dissipation member 50 that dissipates heat of the lighting device 36.

In addition, the panel assembly 30 may include a light guide plate 33 disposed behind the panel 31. In addition, the panel assembly 30 may include a mounting member 32 provided between the panel 31 and the light guide plate 33 so that the panel 31 and the light guide plate 33 are mounted. The mounting member 32 may be omitted, and the panel 31 or the light guide plate 33 may be fixed in a structure different from that of the foregoing embodiment.

In addition, the panel assembly 30 may include an upper bracket 34 defining a top surface and a lower bracket 35 defining a bottom surface. In addition, the lighting device 36 that emits light to the light guide plate 33 may be provided inside the lower bracket 35.

In addition, the panel assembly 30 may include a heat dissipation member 50. The heat dissipation member 50 may be provided between the light guide plate 33 and the back cover 39. The heat dissipation member 50 may be configured to dissipate heat from the lighting device 36 and may be made of a material having excellent thermal conductivity. The lighting device 36 may be prevented from being overheated by the heat dissipation member 50. In addition, the heat generated by the lighting device 36 may be transferred to a position away from a position, at which the user is accessible, by the heat dissipation member 50.

The heat dissipation member 50 may be made of a metal material having excellent thermal conductivity. For example, the heat dissipation member 50 may be made of aluminum or copper. In the fifth embodiment, since the heat dissipation member 50 has a structure extending upward from a lower end of the door 20, a heated working fluid 533*a* may naturally flow upward. Thus, the heat dissipation member 50 may satisfy heat dissipation performance even if the heat dissipation member 50 is molded using a relatively inexpensive aluminum material without using an expensive copper material.

The heat dissipation member 50 may be provided in a plate shape having a predetermined thickness. In addition, at least one chamber 533 in which the working fluid 533*a* is accommodated may be provided in the heat dissipation member 50. A plurality of chambers 533 may be continuously disposed in a left and right direction. The heat dissipation member 50 may allow heat transfer coefficient to increase by the working fluid 533*a* inside the chamber 533 and may further improve the heat dissipation performance of the lighting device 36. The heat dissipation member 50 may be referred to as a vacuum chamber or a vapor chamber. In addition, the chamber 533 may be referred to as a closed space, a fluid accommodating portion, a cavity, or the like.

For example, the working fluid 533*a* may be a liquid that is capable of being vaporized by the heat generated during an operation of the lighting device 36. For example, water may be used as the working fluid inside the chamber 533. In addition, when the lighting device 36 operates to rise a temperature to about 24° C., the working fluid 533*a* may be vaporized. Here, since the inside of the chamber 533 is in a vacuum state, the working fluid 533*a* may be vaporized even at a temperature much lower than a boiling point. When the working fluid 533*a* is vaporized in the chamber 533, molecular motion may become more active, and thus, heat transfer performance may be improved.

The working fluid 533*a* inside the heat dissipation member 50 may be heated and vaporized by the lighting device 36, and the vaporized working fluid 533*a* may flow upward along the chamber 533 to move to the back cover 39 having a relatively low temperature. In addition, the working fluid 533*a* of which a temperature is lowered while moving along the chamber 533 may be condensed and liquefied to move downward by its own weight. Of course, a wick having a capillary structure for guiding the movement of the working fluid 533*a* condensed inside the chamber 533 may be further provided, or a structure for the movement of the working fluid 533*a* condensed on an inner wall surface of the chamber 533 may be provided.

As another example, the working fluid 533*a* may be a nanofluid containing fine particles having excellent thermal conductivity. The working fluid 533*a* may flow inside the heat dissipation member 50, i.e., within the chamber 533 to effectively transfer the heat of the lighting device 36 toward the back cover 39 and then be dissipated.

The heat dissipation member 50 may support the lighting device 36 from the below and simultaneously may be in contact with the back cover 39. The heat dissipation member 50 may include a front surface 531 and a rear surface 532. Here, the front surface 531 of the heat radiation member 50 may face the lighting device 36, and the rear surface 532 may be in contact with the back cover 39. In addition, the chamber 533 may be disposed between the front surface 531 and the rear surface 532 of the heat dissipation member 50.

In detail, the heat dissipation member 50 may include a first part 51 disposed below the lighting device 36 and second parts 52 and 53 extending along the back cover 39. The first part 51 may support the lighting device 36, and the second parts 52 and 53 may dissipate and transfer the heat generated by the lighting device 36 through the back cover 39. Thus, the heat dissipation member 50 may simultaneously perform the functions of supporting and dissipating the lighting device 36 in a single configuration. In addition, the heat dissipation member 50 may further improve heat dissipation efficiency by connecting the lighting device 36 that emits the heat to the back cover 39 that emits the heat in a minimal configuration.

The first part 51 may extend between a substrate 361 of the lighting device 36 and a bottom surface inside the lower bracket 35. In addition, the first part 51 may extend forward from a rear end of the substrate 361 and may extend to a front end of the substrate 361 in a state of being in contact with a bottom surface of the substrate 361. The first part 51 may extend in parallel with the bottom surface of the substrate 361 and thus maximize a contact area with the bottom surface of the substrate 361 so that the heat of the lighting device 36 is effectively transferred. An adhesive may be applied between the substrate 361 and the first part 51, and the adhesive may also include a thermally conductive material.

In addition, the first part 51 may have a top surface that is in contact with the substrate 361 and a bottom surface that is in contact with the bottom surface of the lower bracket to stably support the substrate 361. Thus, even when the door is opened and closed, the lighting device 36 may be maintained at the initially mounted position and may not move or deviate from the mounting position.

The second parts 52 and 53 may extend upward from the rear end of the first part 51. The second parts 52 and 53 may be integrated with the first part 51. Thus, the heat dissipation member 50 may be provided in a plate shape and then bent to provide the first part 51 and the second parts 52 and 53.

The second parts 52 and 53 may extend upward in a direction crossing the first part 51 and may extend in a direction parallel to the back cover 39. In addition, when the back cover 39 is mounted, the rear surfaces 532 of the second parts 52 and 53 may be in close contact with the front surface of the back cover 39. In addition, an adhesive may be provided between the second parts 52 and 53 and the back cover 39 to adhere to each other. Thus, when the back cover 39 is assembled and mounted, the heat dissipation member 50 may be mounted or separated in the state of being attached to the back cover 39.

The heat dissipation member 50 may have a width corresponding to a horizontal width of the back cover 39 or a horizontal width of the lighting device 36. In addition, the second part may be disposed at a height at which the heat dissipation member 50 secures a set amount of transferable heat. For example, the second part may extend higher than a height of the handle 457 disposed on the door 20. That is, the heat dissipation member 50 may further extend in a recessed direction of the handle 457. In addition, at least a portion of the heat dissipation member 50 may be disposed to overlap the lighting device 36 and the handle 547 when viewed from the front.

The second parts 52 and 53 may include a second part lower portion 52 and a second part upper portion 53 according to the shape of the back cover 39 or the shape of the lower bracket 35. In detail, the second part lower portion 52 may extend upward from the rear end of the first part 51 and may be in contact with the lower bracket rear portion 352 and a cover circumference portion 392 of the back cover 39. The second part lower portion 52 may be provided in a shape corresponding to the recessed shape of the cover circumference portion 392.

The second part upper portion 53 may extend upward from the second part lower portion 52. The second part upper portion 53 may extend upward between the light guide plate 33 and the back cover 39. In addition, the second part upper portion 53 may be connected to the second part lower portion 52 by an inclined or rounded connection portion 521. The second part lower portion 52, the connection portion 521, and the second part upper portion 53 may be bent to have a shape corresponding to the shape of the back cover 39. Thus, the entire rear surface of the second parts 52 and 53 may be completely in close contact with the back cover 39.

The chamber 533 may extend in a vertical direction and may extend from the first part 51 to the second parts 52 and 53. In addition, a plurality of chambers 533 may be arranged in parallel and may be disposed continuously with a partition wall 534 therebetween. The chamber 533 may be continuously disposed from one end to the other end of the heat dissipation member 50 and be filled with the working fluid 533*a*.

The heat dissipation member 50 may be extrusion-molded to facilitate molding of the plurality of chambers 533. During the extrusion-molding, the heat dissipation member 50 is extruded in the vertical direction so that the plurality of chambers 533 are molded at once. In addition, the heat dissipation member 50 may be bent into the first part 51 and the second parts 52 and 53 after being extruded. In addition, after the heat dissipation member 50 is extruded, an upper sealing portion 535 and a lower sealing portion 511 may be provided at upper and lower ends to seal an opened upper and lower ends of the chamber 533, respectively. Thus, the inside of the chamber 533 may be in a vacuum state, and a phase change of the working fluid 533*a* inside the chamber 533 may be more easily achieved.

When the heat dissipation member 50 is extrusion-molded, in order to facilitate the molding, a plurality of heat dissipation members 50 may be molded in the same shape and then be continuously connected to each other in a transverse direction. For example, the heat dissipation member 50 may be configured by combining a plurality of pieces 50*a*, 50*b*, and 50*c* having the same shape. That is, in the heat dissipation member 50, the first piece 50*a*, the second piece 50*b*, and the third piece 50*c* may be continuously disposed, and side ends adjacent to each other may be connected to provide the entire heat dissipation member 50.

For this, a first coupling portion 541 and a second coupling portion 542 may be disposed at both left and right ends of each of the pieces 50*a*, 50*b*, and 50*c*. The first coupling portion 541 and the second coupling portion 542 may be stepped in a shape corresponding to the each other so that the first coupling portion 541 and the second coupling portion 542 are seated to be coupled to each other. Thus, when the plurality of pieces 50*a*, 50*b*, and 50*c* are disposed to be in contact with each other, the first coupling portion 541 and the second coupling portion 542, which are adjacent to each other, may be seated so that the stepped portions are engaged with each other. In this state, the plurality of pieces 50*a*, 50*b*, and 50*c* may be coupled to each other through spot welding or riveting. The first coupling portion 541 and the second coupling portion 542 may extend from upper ends to lower ends of the second parts 52 and 53 to realize ease of the molding and coupling.

Due to the structural characteristics of the first coupling portion 541 and the second coupling portion 542, the chamber 533 may not be provided in the first coupling portion 541 and the second coupling portion 542. In addition, a jig hole 536 in which the plurality of pieces 50*a*, 50*b*, and 50*c* are mounted when the plurality of pieces 50*a*, 50*b*, and 50*c* are coupled to each other may be opened in the heat dissipation member 50. The jig hole 536 may be defined in the first coupling portion 541 and the second coupling portion 542 to prevent a loss of the chamber 533.

In addition, an opening 523 through which a connector guide 359 disposed on the lower bracket 35 passes may be defined in a lower portion of each of the second parts 52 and 53. An electric wire connected to the lighting device may be accessible through the connector guide 359.

In addition, a through-hole 522 through which a screw 393 coupled when the back cover 39 is coupled may be opened at a lower portion of each of the second parts 52 and 53. Thus, the back cover 39 may be coupled in the state in which the heat dissipation member 50 is mounted, and the screw 393 may be coupled to the lower bracket 35 by passing through the back cover 39 and the dissipation member 50.

The back cover 39 may be fixed to the upper bracket 34 and the lower bracket 35 by coupling a screw 393 to each of the upper and lower ends. The back cover 39 may be made of a plate-shaped metal material, and a cover protrusion 391, a cover circumference portion 392, and a heat dissipation member support portion 399 may be provided through forming.

In detail, the heat dissipation member support portion 399 on which the second parts 52 and 53 are supported may be disposed under the back cover 39. The heat dissipation member support portion 399 may connect a lower end of the cover protrusion 391 to the cover circumference portion 392 and may be provided to support the heat dissipation member 50 from the rear. In addition, the heat dissipation member support portion 399 may be recessed backward rather than the cover protrusion 391 to accommodate at least the second part upper portion 53 of the second parts 52 and 53.

The heat dissipation member support portion 399 may protrude forward rather than the cover circumference portion 392, but may be disposed behind the cover protrusion 391. That is, the heat dissipation member support portion 399 may be disposed between the cover protrusion 391 and the cover circumference portion 392 in a front and rear direction. Thus, when the back cover 39 is molded, a rear surface of the back cover 39 may be formed to protrude in order of the cover protrusion 391, the heat dissipation member support portion 399, and the cover circumference portion 392.

Thus, when the back cover 39 is mounted, the back cover 39 may support the heat dissipation member 50 from the rear by the heat dissipation member support portion 399. In addition, the back cover 39 may further support the light guide plate 33 from the rear by the cover protrusion 391 in the mounted state.

Although not shown, a graphite sheet 385 may be further disposed on the back cover 39. In addition, a heat sink 38 may be further disposed on the back cover 39.

Hereinafter, a state in which heat generated when the lighting device 36 is driven is transferred and dissipated will be described.

Figure 21:
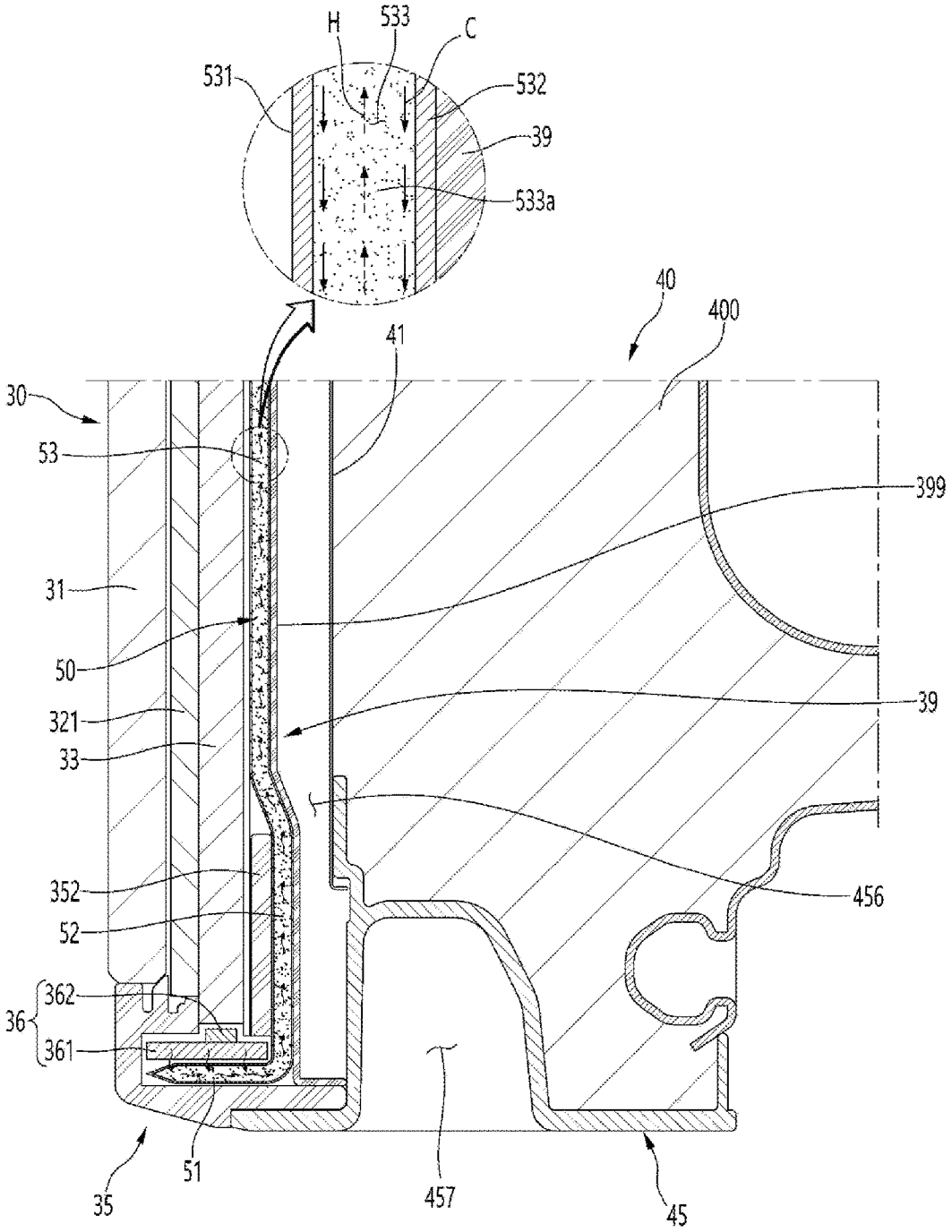
FIG. 21 is a cross-sectional view of a door on which the panel assembly is mounted.

FIG. 21 is a cross-sectional view of a door on which the panel assembly is mounted.

As illustrated in the drawing, when the panel assembly is assembled and mounted on the door 20, the back cover 39 may face the front surface of the door body 40, i.e., the body plate 41. Here, the back cover 39 and the body plate 41 may be spaced apart from each other to define a space 456.

In this state, the lighting device 36 may be driven to express a color of the door 20 through the front surface of the panel assembly 30. When the lighting device 36 is turned on, the lighting device 36 generates heat. In addition, the heat generated by the lighting device 36 may be transferred and radiated to the back cover 39 through the heat dissipation member 50.

In detail, the heat generated by the lighting device 36 may be transferred to the heat dissipation member that is in contact with the substrate 361, i.e., the first part 51. Here, the heat dissipation member 50 itself may be made of a metal material having excellent thermal conductivity, and after the heat of the first part 51 is conducted to the second parts 52 and 53, the seconds part 52 and 53 may be transferred to the contacting back cover 39.

In addition, the second parts 52 and 53 may extend upward along the back cover 39 to transfer the heat upward along the back cover 39. In addition, the heat transferred to the back cover 39 may be radiated to the space 456.

Here, since the chamber 533 extends in the vertical direction on the heat dissipation member 50, and the working fluid 533*a* is accommodated in the chamber 533, the heat of the lighting device 36 may be more effectively transferred to the back cover 39.

That is, the chamber 533 may extend from a position overlapping the lighting device 36 to extend upward by a set distance from the lower end of the back cover 39. Thus, the heat generated by the lighting device 36 may be effectively transferred to the upper ends of the second parts 52 and 53 by the working fluid 533*a* inside the chamber 533.

Looking at this in more detail, the working fluid 533*a* may be initially filled in the chamber 533 in a liquid state and may be vaporized by heat generated during the operation of the lighting device 36.

The heat generated when the lighting device 36 operates may be transferred to the first part 51 of the heat dissipation member 50 that is in contact with the substrate 361. The working fluid 533*a* disposed in the first part 51 may be vaporized by the heat transferred from the lighting device 36. Particularly, the inside of the chamber 533 may be in a vacuum state, and the working fluid 533*a* may be vaporized even at a temperature (e.g., 24° C.) heated by the lighting device 36.

The working fluid 533*a* in a gaseous state H may move upward along the chamber 533, and the heat of the lighting device 36 may be transferred upward by the working fluid 533*a* in the gaseous state H. Here, the second parts 52 and 53 may be in contact with the back cover 39, and the working fluid 533*a* in the chamber 533 may move upward while dissipating the heat through the back cover 39.

When the working fluid 533*a* dissipates the heat while moving upward, the temperature of the working fluid 533*a* may be lowered again. In addition, when the working fluid 533*a* reaches a temperature at which the working fluid 533*a* is condensed, the working fluid 533*a* may be in a liquid state C again. In addition, the working fluid 533*a* in the liquid state C may move downward along the chamber 533 by its own weight or a capillary structure.

The working fluid 533*a* flowing downward may be again heated by the heat of the lighting device 36 to become the gaseous state H, and after transferring the heat of the lighting device 36 upward, the heat may be dissipated through the back cover 39 so that the working fluid may become a liquid state C. Through a phase change and circulation process of the working fluid 533*a* as described above, the heat may be continuously transferred to the back cover 39 through the heat dissipation member 50 of the lighting device 36.

In addition, the upper end of the heat dissipation member 50 extends to a position higher than the handle 457. Thus, the heat of the lighting device 36 may be transferred and radiated to one side of the back cover 39 at a position higher than the handle 457.

Thus, even when the user touches a lower end of the front surface of the panel 31 adjacent to the lighting device 36, the user may not feel the heat.

In addition, even when the handle 457 is disposed at the position adjacent to the lighting device 36, for example, a lower cap decoration 45, the heat of the lighting device 36 may be transferred to a position away from the handle 457.

That is, since the heat generated by the lighting device 36 is transferred to a position higher than the handle 457 by the heat dissipation member 50, even if the user holds the handle 457, the user may not feel the heat of the lighting device. As described above, the transfer of the heat to the outer surface of the door 20 that is capable of being contacted by the user may be prevented by the heat transfer and heat dissipation by the dissipation member 50.

In addition, a space 456 may be defined between the panel assembly 30 and the rear surface of the door body 40 to prevent the heat radiated from the back cover 39 from being directly transferred to the door body 40. In this case, the space 456 may be defined in at least an area corresponding to the position of the heat dissipation member 50 to further prevent the heat from being transferred to the handle 457.

There may be various other embodiments other than the aforementioned embodiments. In another embodiment of the present disclosure, a heat dissipation member is provided by coupling molded upper and lower portions to each other. In another embodiment of the present disclosure, other constitutes except for a heat dissipation member have the same structure as those in at least one foregoing embodiment, and thus, the same reference numerals are used for the same constitute, and detailed descriptions thereof will be omitted. In addition, reference numerals that are not described or reference numerals that are not shown have the same configuration as the same reference numerals in the foregoing embodiment, and descriptions thereof will be omitted.

Hereinafter, a sixth embodiment of the present disclosure will be described with reference drawings.

Figure 22:
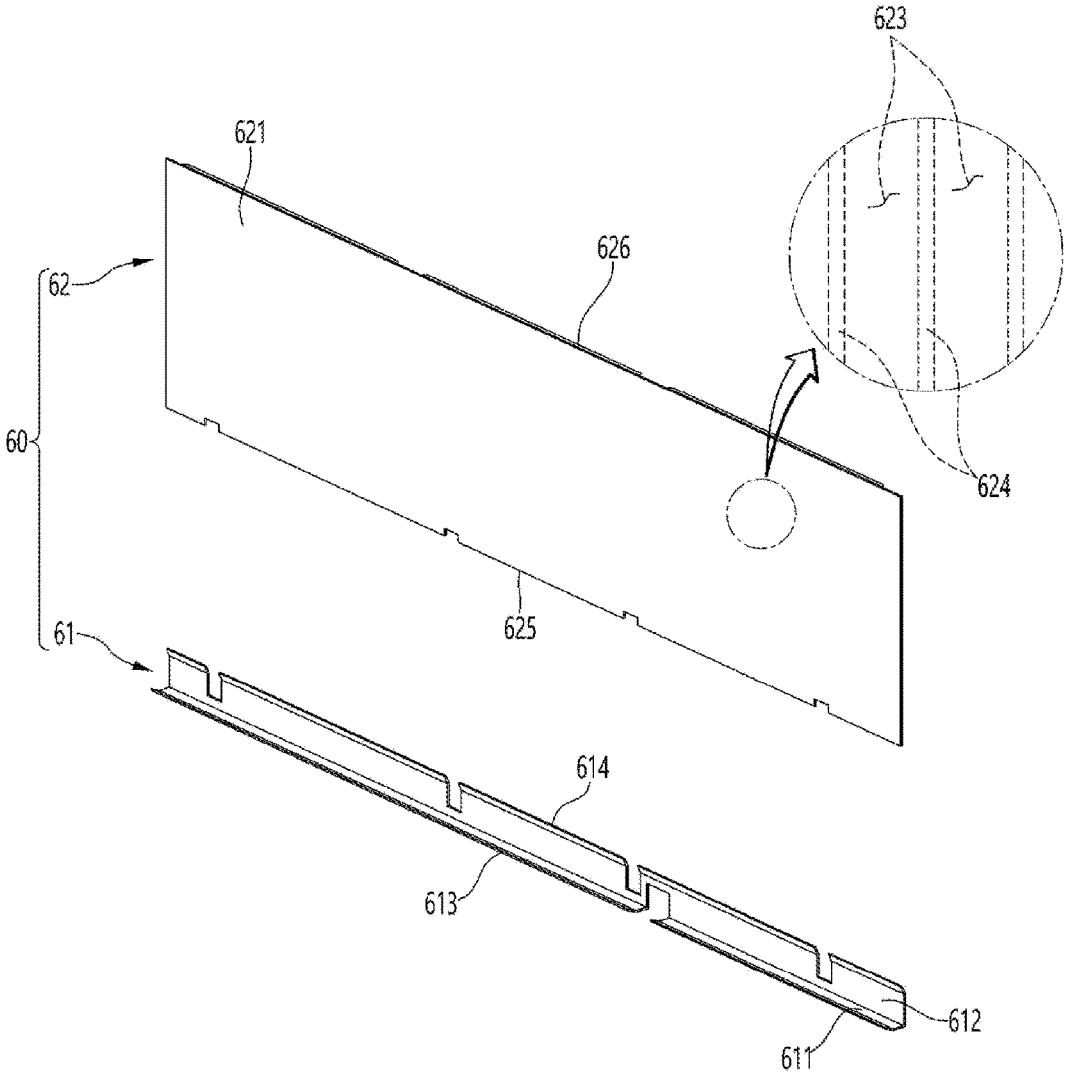
FIG. 22 is an exploded perspective view of a heat dissipation member according to a sixth embodiment.
Figure 23:
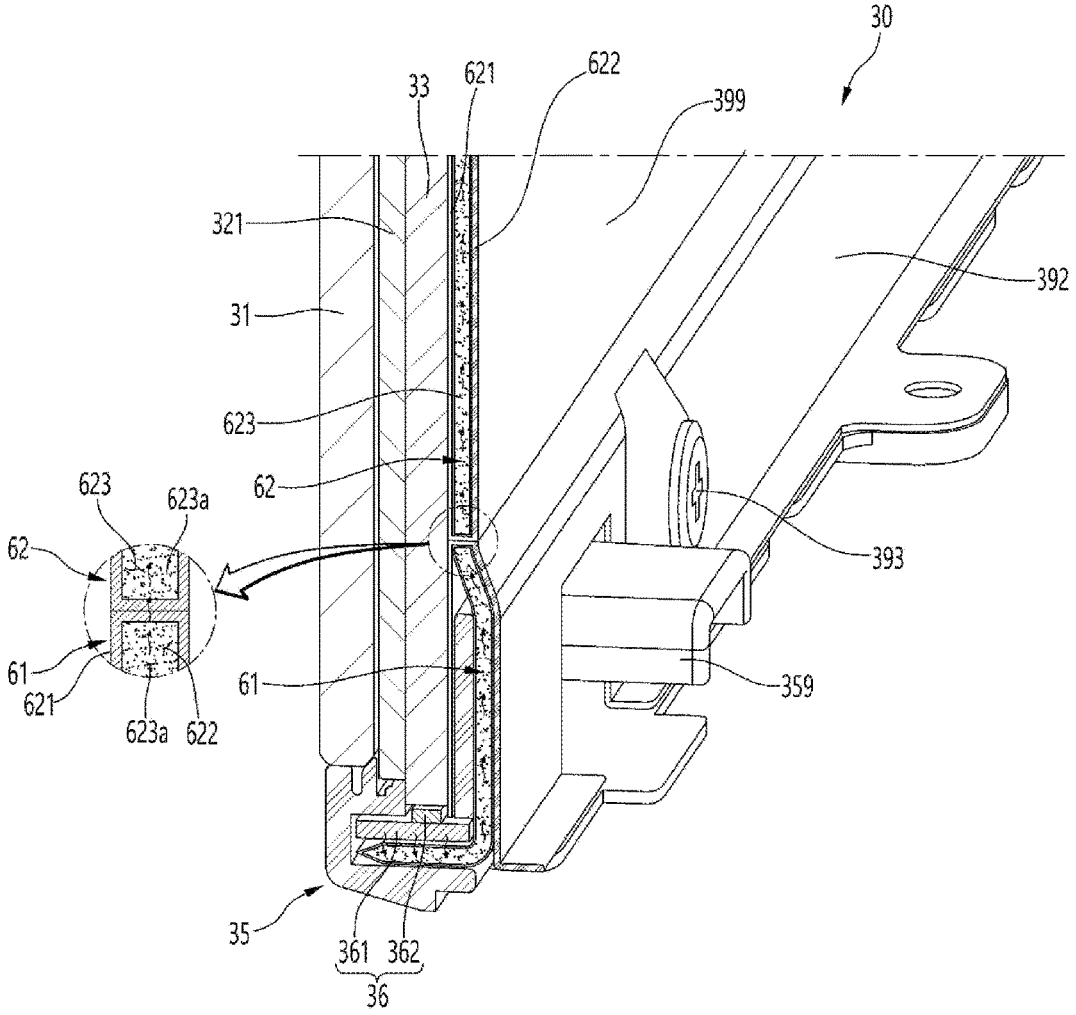
FIG. 23 is a cutaway perspective view of a panel assembly on which the heat dissipation member is mounted.

FIG. 22 is an exploded perspective view of a heat dissipation member according to a sixth embodiment. Also, FIG. 23 is a cutaway perspective view of a panel assembly on which the heat dissipation member is mounted.

As illustrated in the drawings, a panel assembly 30 of a refrigerator 1 according to a sixth embodiment may be mounted on a door body 40 and configured to be detached from the door body 40.

The panel assembly 30 includes a panel 31 defining an outer appearance of a front surface thereof, a back cover 39 defining an outer appearance of a rear surface thereof, a lighting device 36 that emits light to the panel 31, and a heat dissipation member 60 that dissipates heat of the lighting device 36.

In addition, the panel assembly 30 may include a light guide plate 33 disposed behind the panel 31. In addition, the panel assembly 30 may include a mounting member 32 provided between the panel 31 and the light guide plate 33 so that the panel 31 and the light guide plate 33 are mounted. The mounting member 32 may be omitted, and the panel 31 or the light guide plate 33 may be fixed in a structure different from that of the foregoing embodiment.

The panel assembly 30 may include an upper bracket 34 defining a top surface of the panel assembly 30 and a lower bracket 35 defining a bottom surface. In addition, the lighting device 36 that emits light to the light guide plate 33 may be provided inside the lower bracket 35.

In addition, the panel assembly 30 may include a heat dissipation member 60. The heat dissipation member 60 may be made of a metal material having excellent thermal conductivity and may be made of, for example, an aluminum or copper material.

The heat dissipation member 60 may be provided to support the lighting device 36 and transfer heat generated by the lighting device 36 to the back cover 39.

In the heat dissipation member 60, like the dissipation member 50 according to the foregoing fifth embodiment, a chamber 623 may be provided between a front surface 621 and a rear surface 622 of the heat dissipation member 60, and a working fluid 623*a* may be filled into the chamber 623. In addition, the overall outer appearance of the heat dissipation member 60 may be provided in a shape similar to that of the heat dissipation member 50 according to the foregoing fifth embodiment.

Of course, the heat dissipation member 60 may be provided in a structure in which the chamber 533 is not provided therein and may be extrusion-molded, or a plate-shaped material may be bent.

In detail, the heat dissipation member 60 may include a first member 61 supporting the lighting device 36 and a second member 62 that is in contact with the back cover 39.

In addition, the first member 61 may include a horizontal portion 611 and a vertical portion 612. The horizontal portion 611 may be extend to be inserted between the substrate 371 and the bottom surface of the lower bracket 35 and may support the substrate 371 from the below. In addition, the horizontal portion 611 may be in surface contact with the substrate 371 so that the heat of the lighting device 36 is effectively transferred to the heat dissipation member 60.

The horizontal portion 611 may extend further backward than the substrate 371, and the vertical portion 612 may extend upward from a rear end of the horizontal portion 611. The vertical portion 612 may be disposed to be in contact with a lower end of the back cover 39, i.e., the cover circumference portion 392. In addition, the vertical portion 612 may extend to a height corresponding to the cover circumference portion 392.

The second member 62 may be disposed above the first member 61 and may be disposed between the back cover 39 and the light guide plate 33. In addition, the second member 62 may be disposed at a position corresponding to the heat dissipation member support portion 399 and may be supported by the heat dissipation member support portion 399.

The second member 62 may have the same width as the first member 61 and may be disposed to be in contact with an upper end of the second member 62. In this case, the second member 62 may extend upward and may extend upward by a predetermined distance from an upper end of the handle 457 of the door 20.

The entire lower end of the second member 62 may be in contact with or adhere to an upper end of the first member 61. Thus, even if the chambers 533 in the first member 61 and the second member 62 do not communicate with each other, the heat transfer may be performed with respect to each other in the state of being in contact with each other.

In addition, since the first member 61 and the second member 62 are separately molded, even if a vertical length of the heat dissipation member 60 is long, it may be easy to extrude the heat dissipation member 60.

The chamber 623 may be provided inside the heat dissipation member 60. The chamber 623 may extend in the vertical direction, and a plurality of chambers 623 may be arranged in parallel in the left and right direction of the heat dissipation member 60. The plurality of chambers 623 may be continuously disposed with a partition wall 624 therebetween.

The chamber 623 may be provided in both the first member 61 and the second member 62. Of course, the chamber 623 may be provided only in one of the first member 61 and the second member 62 according to the shape of the heat dissipation member 60.

The working fluid 623*a* may be filled in the chamber 623, and an internal structure and the working fluid 623*a* of the chamber 623 may be the same as those in the fifth embodiment.

In addition, a first member upper end 614 and a second member lower end 613 may be disposed at the upper and lower ends of the first member 61, respectively. The upper end of the first member 614 and the lower end of the first member 613 may be provided to seal the upper end and the lower end of the chamber 623 provided in the first member 61. Thus, the chamber 623 in the first member 61 may be sealed after being filled with the working fluid 623*a* to be in a vacuum state.

In addition, a second member upper end 626 and a second member lower end 625 may be disposed at the upper end and lower end of the second member 62, respectively. The second member upper end 626 and the second member lower end 625 may be provided to seal the upper end and the lower end of the chamber 623 provided in the second member 62. Thus, the chamber 623 in the second member 62 may be sealed after being filled with the working fluid 623*a* to be in a vacuum state.

When the lighting device 36 is driven in a state in which the panel assembly 30 is mounted, the heat generated by the lighting device 36 may be transferred to the back cover 39 through the heat dissipation member 60 and then be dissipated.

The heat generated by the lighting device 36 may be transferred to the first member 61 that is in contact with the substrate 371 and then may be transferred to the second member 62 along the first member 61. Here, in the state in which the first member 61 and the second member 62 are in contact with each other, the heat transferred to the upper end of the first member 61 may be transferred upward along the lower end of the second member 62.

In addition, the upper end of the first member 61 may extend upward rather than the end of the handle 457. Thus, the heat transferred through the heat dissipation member 60 may be transferred and radiated to the back cover 39 at a side above the handle 457.

When the chamber 623 is provided in at least a portion of the heat dissipation member 60, the working fluid 623*a* may flow along the chamber 623 to transfer the heat of the lighting device 36. In detail, the working fluid 623*a* in a liquid state C at the lower end of the chamber 623 may be heated by the heat of the lighting device 36 so as to be vaporized into a gaseous state H. In addition, the working fluid 623*a* in the gaseous state H may be thermally dissipated while flowing upward along the chamber 623. The working fluid 623*a* in the gaseous state H may flow to the upper end of the heat dissipation member 60 to transfer the heat of the lighting device 36 upward. In addition, when the working fluid 623*a* flowing to the upper end of the chamber 623 reaches a condensation temperature due to the heat dissipation, the working fluid 623*a* may be condensed into the liquid state C. The working fluid 623*a* of the liquid state C may fall by its own weight or moves downward of the chamber 623 by a capillary structure. The working fluid 623*a* moving to the lower end of the chamber 623 may be heated again by the lighting device 36, and the heat of the lighting device 36 may be continuously transferred and radiated to the back cover 39 while the phase change and circulation of the working fluid 623*a* are repeatedly performed in the chamber 623.

When the chamber 623 is provided in each of the first member 61 and the second member 62, the working fluid 623*a* may be independently circulated in the chamber 623 of each of the first member 61 and the second member 62, and thus, the heat may be transferred from the first member 61 to the second member 62. Due to this action, the heat dissipation member 60 may prevent heat from be generated in the outer surface of the door that is in contact with the user and prevent the user from feeling the heat even when the user opens or closes or operates the door 20.

Although not shown, a graphite sheet 385 may be further disposed on the back cover 39. In addition, a heat sink 38 may be further disposed on the back cover 39.

There may be various other embodiments other than the aforementioned embodiments. In another embodiment of the present disclosure, a lighting device is disposed on a top surface of a panel assembly, and a heat dissipation member that transfers and dissipate heat of the lighting device is provided. In another embodiment of the present disclosure, other constitutes except for structures of an upper bracket and an upper cap decoration, which constitute an upper door, have the same structure as those in at least one foregoing embodiment, and thus, the same reference numerals are used for the same constitute, and detailed descriptions thereof will be omitted. In addition, reference numerals that are not described or reference numerals that are not shown have the same configuration as the same reference numerals in the foregoing embodiment, and descriptions thereof will be omitted.

Hereinafter, a seventh embodiment of the present disclosure will be described with reference drawings.

Figure 24:
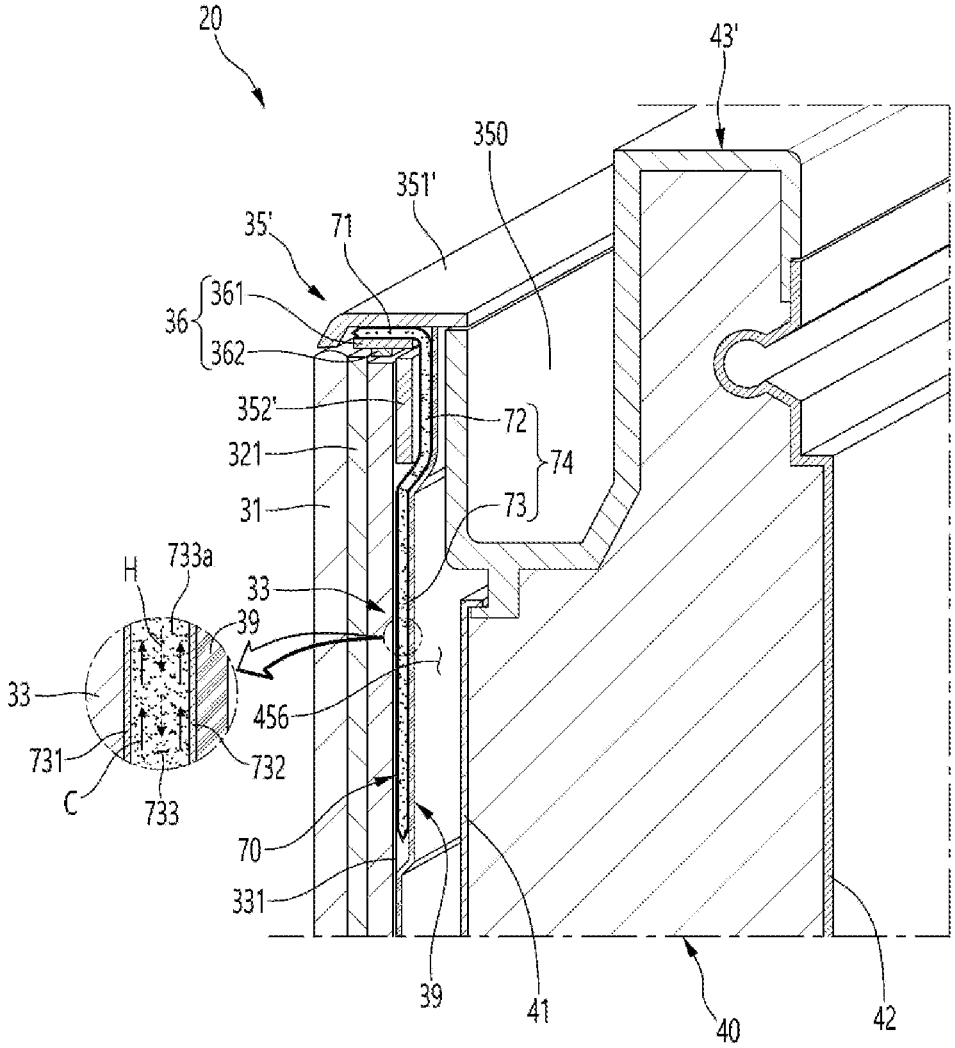
FIG. 24 is a cutaway perspective view of a door according to a seventh embodiment.

FIG. 24 is a cutaway perspective view of a door according to a seventh embodiment.

As illustrated in the drawing, a door 20 of a refrigerator according to a seventh embodiment may include a panel assembly 30 and a door body 40. The door 20 may be a door 20 having a handle 350 in a top surface thereof, like the freezing compartment door 202 in FIG. 1. Of course, the door 20 is not limited to the freezing compartment door 202.

The door body 40 may open and close a storage space and include a body plate 41 defining a front surface, a door liner 42 defining a rear surface, an upper cap decoration 43' defining a top surface, and a lower cap decoration 45 defining a bottom surface. In addition, the door body 40 may include a side decoration 44 defining each of left and right surfaces. Also, an insulator 400 may be filled inside the door body 40.

In addition, a handle 350 may be recessed in a top surface of the door 20, i.e., the upper cap decoration 43'. The handle 350 may be disposed along the top surface of the door 20 and may be recessed to a depth that is sufficient to allow a user to hold the handle 350.

The panel assembly 30 may be detachably mounted on the front surface of the door body 40. The panel assembly 30 may define the entire front surface of the door body 40 in the mounted state. Furthermore, the panel assembly 30 may define an outer appearance of the front surface of each of the door 20 and the refrigerator 1.

In addition, as in the above-described embodiment, the panel assembly 30 may include a panel 31 defining an outer appearance of the front surface, a lighting device 36 emitting light to the panel 31, a back cover 39 defining the rear surface of the panel assembly 30, and a heat dissipation member 70 that dissipates heat of the lighting device 36.

In addition, the panel assembly 30 may include an upper bracket 35' defining a top surface of the panel assembly 30 and a lower bracket 34 defining a bottom surface of the panel assembly 30.

The upper bracket 35' may include an upper bracket top surface portion 351 defining a top surface of the panel assembly 30 and an upper bracket rear surface portion 352 extending downward to cross the upper bracket top surface portion 351. The upper bracket top surface portion 351 and the upper bracket rear surface portion 352 may be spaced apart from each other to define an opening through which a portion of each of the lighting device 36 and the heat dissipation member 70 is accessible.

In addition, the lighting device 36 may be mounted on the lower bracket 35'. The lighting device 36 may include a substrate 361 extending along the panel 31 and a plurality of LEDs 362 arranged at regular intervals on the substrate 361.

The LED 362 may be disposed to face a downward side so as to emit light to a light guide plate 33. The light guide plate 33 may have the same structure as that of the foregoing embodiment and reflect the light irradiated from above to a front side so that the entire surface of the panel 31 is evenly illuminated. Thus, the lighting device 36 may be disposed along an upper end of the light guide plate 33. In addition, a reflective layer 331 that reflects the light forward may be further disposed on a rear surface of the light guide plate 33.

The panel assembly 30 may further include a mounting member 32. The panel 31, the upper bracket 35', and the lower bracket 34 may be fixedly mounted to the mounting member 32. The mounting member 32 may have the same structure as that of the foregoing embodiment. For example, the panel 31 may be coupled to a front surface portion 321, and both ends of the light guide plate 44, the upper bracket 35', and the lower bracket 34 may be mounted on both left and right side surface portions 322.

One side of the heat dissipation member 70 may be in contact with the lighting device 36, and the other side may be in contact with the back cover 39. Thus, the heat dissipation member 70 may transfer and radiate the heat generated by the lighting device 36 to the back cover 39. The overall structure and shape of the heat dissipation member 70 may be the same as those of the foregoing fifth or sixth embodiment, and only the arrangement position may be changed to an upper portion of the panel assembly 30.

In detail, the heat dissipation member 70 may be made of a metal material having excellent heat transfer performance and may have one side that supports the lighting device 36 and the other side that extends downward in a state of being in contact with the back cover 39. Here, the extending lower end of the heat dissipation member 70 may extend further downward than a recessed lower end of the handle 350.

The heat dissipation member 70 may include a first part 71 that supports the lighting device 36 and a second part 74 that is in contact with the back cover 39. The second part 74 may extend in the same direction as the extension direction of the back cover 39, and the first part 71 may extend in a direction crossing the second part 74.

The first part 71 may be disposed between a substrate 361 and an upper bracket 35' and may support a top surface of the substrate 361. Here, a front end of the first part 71 may extend up to a front end of the substrate 361. A rear end of the first part 71 may extend to a rear side of the substrate 361, and the second part 74 may be disposed at the extending end of the first part 71.

The second part 74 may extend upward from the rear end of the first part 71. The second part 74 may extend downward in a state of being in contact with a front surface of the back cover 39 and may include a second part upper portion 72 and a second part lower portion 73.

The second part upper portion 72 may be bent downward from the rear end of the first part 71, and the second part lower portion 73 may further extend downward from a lower end of the second part upper portion 72. Here, the second part upper portion 72 and the second part lower portion 73 may have a height difference to be in close contact with the front surface of the back cover 39. The second part 74 may be maintained in the state of being close contact with the back cover 39, and heat of the heat dissipation member 70 may be effectively transferred to the back cover 39.

In addition, the second part lower portion 73 may extend further downward than a lower end of a handle 350. Thus, the heat transferred along the heat dissipation member 70 may be dissipated through the back cover 39 at a side below the handle 350.

In the heat dissipation member 70, one or more chambers 733 in which a working fluid **733*a* is provided may be provided between a front surface 731 and a rear surface 732. A chamber structure of the heat dissipation member 70** may have the same structure as that of the foregoing fifth and sixth embodiments.

A plurality of the chambers 733 may be continuously disposed along the heat dissipation member 70 and may be arranged in parallel in a left and right direction. In addition, the chamber 733 may extend in a vertical direction and may extend from an end of the first part 71 to an end of the second part 74. Thus, heat generated in the lighting device 36 by the flow of the working fluid **733*a* filled in the chamber 733 may be effectively transferred downward to one point of the back cover 39**.

The heat dissipation member 70 may be made of an aluminum material or a copper material having excellent thermal conductivity. However, since the heat dissipation member 70 has to transfer the heat of the lighting device 36 disposed above to one point of the back cover 39 disposed below, when the heat dissipation member 70 is made of the copper material having the excellent thermal conductivity, the heat of the lighting device 36 may be more effectively guided downward.

The back cover 39 may be made of a metal material and may define a rear surface of the back cover 39. The back cover 39 may connect an upper bracket 35' to a lower bracket 34, and both left and right ends of the back cover may support both sides of the mounting member 32.

The back cover 39 may include a cover protrusion 391 supporting the light guide plate 33 from the rear and a cover circumference portion 392 defining a circumference of the back cover 39. In addition, the back cover 39 may have a size corresponding to a position corresponding to the second part 74 of the heat dissipation member 70 so that a heat dissipation member support portion 399 that supports the heat dissipation member 70 from the rear is disposed.

In addition, the back cover 39 may connect the upper bracket 35', the lower bracket 34, and the mounting member 32 to each other to complete the overall coupling structure of the panel assembly 30.

Hereinafter, a state in which heat generated when the lighting device 36 is dissipated driven is will be described.

As illustrated in FIG. 24, when the panel assembly 30 is assembled and mounted on the door 20, the back cover 39 may face the front surface of the door body 40, i.e., the body plate 41. Here, the back cover 39 and the body plate 41 may be spaced apart from each other to define a space 456.

In this state, the lighting device 36 may be driven. While the lighting device 36 is driven, the lighting device 36 generates heat. In addition, the heat generated by the lighting device 36 may be transferred and radiated to the back cover 39 through the heat dissipation member 70.

In detail, the heat generated by the lighting device 36 may be transferred to the heat dissipation member 70 that is in contact with the substrate 361, i.e., the first part 71. After the heat of the first part 71 is conducted to the second part 74, the second part 74 may be transferred to the contacting back cover 39. Here, since the heat dissipation member 70 has high thermal conductivity, the heat generated by the lighting device 36 may not be transferred to a front side of the panel assembly 30, but be transferred to the back cover 39 along the heat dissipation member 70.

Here, the second part 74 may extend further downward than a recessed lower end of a handle 350, and thus, the heat of the lighting device 36 may be transferred to one side of the back cover 39 that is away from the handle 350.

In addition, the chamber 733 provided in the heat dissipation member 70 may extend from the first part 71 to the second part 74, and the heat of the lighting device 36 may be transferred downward by a working fluid 733*a* filled therein.

In detail, the chamber 733 may extend downward from the upper lighting device 36, and the working fluid 733*a* therein may be heated by the lighting device 36. The working fluid 733*a* may be initially filled in a liquid state and may be vaporized by heat generated in the lighting device 36.

The working fluid 733*a* that is in a gaseous state H may move downward along the chamber 733 and then more effectively transfer the heat of the lighting device 36 downward by the flowing of the working fluid 733*a* that is in the gaseous state.

When the working fluid 733*a* moves downward, a temperature of the working fluid 733*a* may be lowered again, and when the working fluid 733*a* reaches a temperature at which the working fluid 733*a* is condensed at a lower end of the chamber 733, the working fluid 733*a* may be in a liquid state C again.

In addition, the working fluid 733*a* in the liquid state C may move upward along the chamber 733 by its own weight. In addition, to facilitate the movement of the working fluid 733*a* in the liquid state C, a wall surface of the chamber 733 may be provided in a shape capable of inducing a capillary phenomenon, or a separate wick may be provided in the chamber 733 so that the working fluid 733*a* that is in the liquid state C moves upward.

The working fluid 733*a* flowing downward may be again heated by the heat generated by the lighting device 36 to become a gaseous state H, and after transferring the heat of the lighting device 36 downward, the heat may be dissipated through the back cover 39. Through a phase change and circulation process of the working fluid 733*a* as described above, the heat of the lighting device 36 may be continuously transferred to the back cover 39 and radiated downward.

In addition, a lower end of the heat dissipation member 70 extends to a position lower than the handle 350. Thus, the heat of the lighting device 36 may be transferred and radiated to the back cover 39 at a position lower than the handle 350.

Thus, even if a user touches an upper end of a front surface of a door 20 adjacent to the lighting device 36, the heat may not be transferred through the panel 31. In addition, even when the handle 350 is disposed on an upper cap decoration 43' adjacent to the lighting device 36, the heat generated by the lighting device 36 may be transferred to a position lower than the handle 350 by the heat dissipation member 70. Thus, even if the user holds the handle 350 to open and close the door 20, the heat of the lighting device 36 may not be transferred.

In addition, a space 456 may be defined between the panel assembly 30 and the rear surface of the door body 40 to prevent the heat from being directly transferred to the door body Here, the space 456 may be defined in at least an area corresponding to an area on which the heat dissipation member 70 is disposed to minimize the heat transfer toward the body 40. Particularly, the transfer of the heat generated in the lighting device 36 to the handle 350 may be minimized.

Although not shown, a graphite sheet 385 may be further disposed on the back cover 39. In addition, a heat sink 38 may be further disposed on the back cover 39.

In addition, although not shown in detail, a structure in which the lighting device 36 and the heat dissipation members 50 and 70 are provided at the upper and lower ends of the panel assembly 30, respectively, by combining the foregoing embodiments will also be possible.

There may be various other embodiments other than the aforementioned embodiments. In another embodiment of the present disclosure, the panel assembly may not include the mounting member according to the foregoing embodiment. In another embodiment of the present disclosure, other constitutes except for a mounting member have the same structure as those in at least one foregoing embodiment, and thus, the same reference numerals are used for the same constitute, and detailed descriptions thereof will be omitted. In addition, reference numerals that are not described or reference numerals that are not shown have the same configuration as the same reference numerals in the foregoing embodiment, and descriptions thereof will be omitted.

Hereinafter, an eighth embodiment of the present disclosure will be described with reference drawings.

Figure 25:
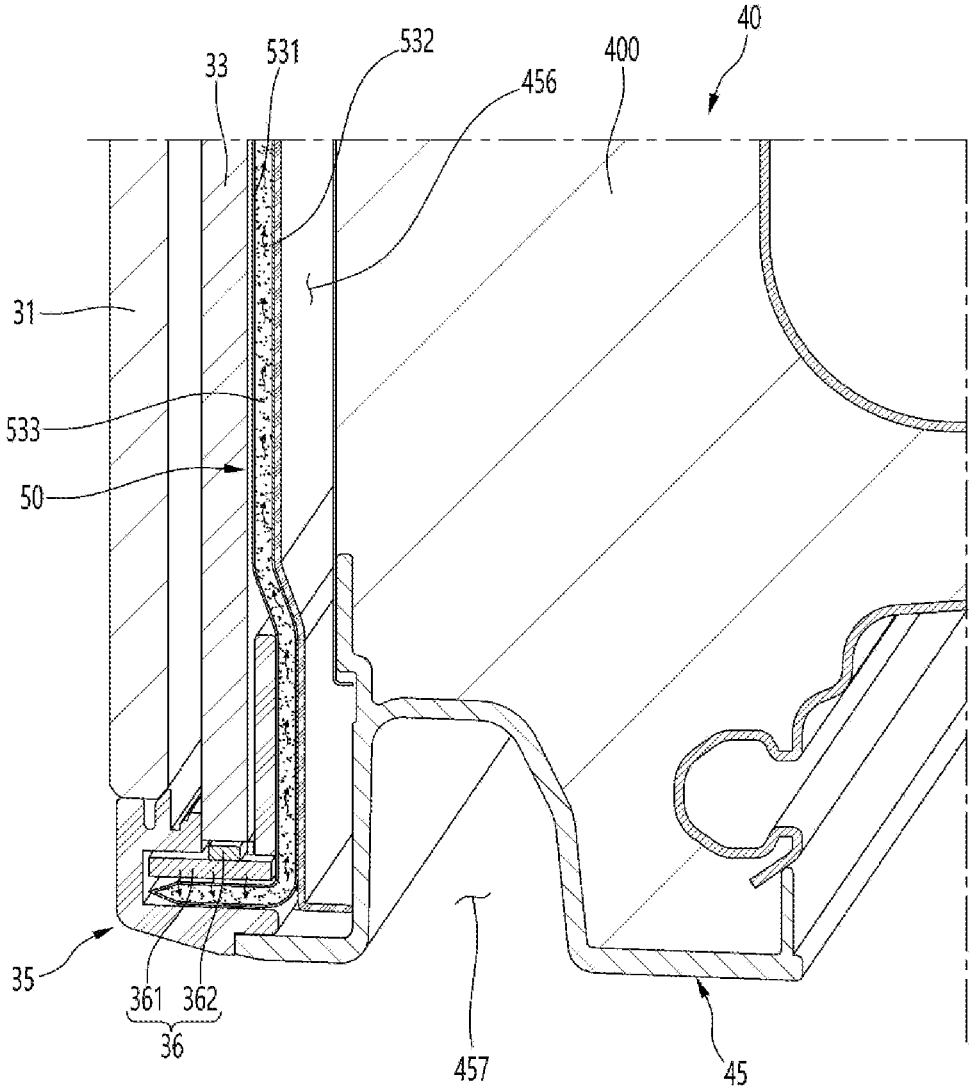
FIG. 25 is a cutaway perspective view of a door according to an eighth embodiment.

FIG. 25 is a cutaway perspective view of a door according to an eighth embodiment.

As illustrated in the drawings, a panel assembly 30 of a refrigerator 1 according to an eighth embodiment may be mounted on a door body 40 and configured to be detached from the door body 40.

The panel assembly 30 may include a panel 31 which defines an outer appearance of a front surface and through which light is transmitted, a back cover 39 that defines an outer appearance of a rear surface, a lighting device 36 capable of illuminating the panel assembly 30 in various colors, and a heat dissipation member 50 that dissipates heat of the lighting device 36.

In addition, the panel assembly 30 may include a light guide plate 33 disposed behind the panel 31. A lower end of each of the panel 30 and the light guide plate 33 may be supported by a lower bracket. In addition, the panel 30 and the light guide plate 33 may be spaced apart from each other.

In addition, the panel assembly 30 may include an upper bracket 34 defining a top surface and a lower bracket 35 defining a bottom surface.

In addition, the lighting device 36 that emits light to the light guide plate 33 may be provided inside the lower bracket 35. Thus, the lighting device 36 may be maintained at a set position inside the lower bracket 35 and may emit light toward an end of the light guide plate 33.

In addition, the panel assembly 30 may include a heat dissipation member 50. The heat dissipation member may be made of a metal material having excellent thermal conductivity, for example, may be made of an aluminum material. The heat dissipation member 50 may be provided to support the lighting device 36 and transfer heat generated by the lighting device 36 to the back cover 39.

For example, a structure and operation of the heat dissipation member 50 may be the same as those of the heat dissipation member 50 of the foregoing fifth embodiment. Thus, heat generated by the driving of the lighting device 36 may be transferred to the back cover 39 through the heat dissipation member 50.

Here, the heat dissipation member 50 may extend upward up to a position above the handle 457, and the heat transferred from the lighting device 36 at the position higher than the handle 457 may be dissipated through the back cover 39.

Thus, even when the door 20 operates, particularly, the door 30 is opened and closed by holding the handle 457, the user may not feel the heat.

In addition, the panel assembly 30 according to the eighth embodiment may not include the heat dissipation member 50, but may include at least one of the heat dissipation members according to the foregoing first to seventh embodiments.

The following effects may be expected in the refrigerator according to the proposed embodiments of the present invention.

In the refrigerator according to the embodiment, the heat dissipation member that dissipates the heat generated in the lighting device within the door may be provided. Therefore, even if the lighting device operates for a long period of time, the lighting device may be prevented from being overheated due to the heat dissipation action by the heat dissipation member. In addition, the overheating of the lighting device may be prevented to improve the durability and the operational reliability of the lighting device.

Particularly, the heat dissipation member may be made of the material having the excellent thermal conductivity or have the structure the excellent thermal conductivity and may be in direct or indirect contact with the lighting device. Therefore, the heat generated in the lighting unit may be smoothly transferred to the back cover through the heat dissipation member, and the heat dissipation may be effectively performed.

In addition, the heat dissipation member may be configured to be in contact with the lighting device and the back cover, thereby minimizing the thermal resistance between the lighting device and the back cover. Therefore, the heat of the lighting device may be more effectively transferred to the specific point of the back cover and then dissipated.

In addition, when the lighting device operates for a long time, the heat of the lighting device may allow the temperature of the outer surface of the panel adjacent to the lighting device to increase. However, the heat generated in the lighting device may be transferred to the back cover and then dissipated by the heat dissipation member. Therefore, the outer surface of the door may be prevented from being overheated.

In addition, the heat dissipation member may extend to the position that is away from the end of the handle. In addition, the heat generated in the lighting device may be transferred to the position that is away from the handle. Therefore, even if the user holds the handle or the outer surface of the door to open and close the door, the heat may be prevented from being transferred to the user.

In addition, the panel assembly may transfer and dissipate the heat of the lighting device by the heat dissipation member. The heat dissipation member may be provided in the sheet or plate shape to have the structure that is in close contact with the back cover. Therefore, the increase in thickness of the panel assembly may be minimized, and thus, the overall structure and size of the door may be slimmed.

Particularly, in the panel assembly, it may be unnecessary to additionally provide the insulator that prevents the heat of the lighting device from being transferred to the user due to the heat dissipation action of the heat dissipation member. Therefore, the panel assembly may be configured to have the minimum thickness.

In addition, the heat dissipation member may be provided in the same shape as the heat sink and disposed in the space between the panel assembly and the door body. Therefore, the heat dissipation member may be disposed without increasing in thickness of the panel assembly or the door.

In addition, the heat dissipation member may include the chamber filled with the thermally conductive working fluid therein, and the chamber may extend from the lighting device to the back cover. Therefore, the heat of the lighting device may be more effectively transferred by the working fluid. In addition, the heat dissipation performance may be secured.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage space; and a door including (i) a door body configured to open and close at least a portion of the storage space and (ii) a panel assembly that is provided at a front of the door body and defines an outer appearance of the door, wherein the panel assembly comprises:

a panel that is made of a transparent material and defines a front surface of the panel assembly, a back cover that is made of metal and defines a rear surface of the panel assembly, a lighting device configured to emit light toward the panel, a light supporter that is made of metal and supports the lighting device, and a heat dissipation member made of a thermally conductive material and in contact with both of the light supporter and the back cover, the heat dissipation member being configured to dissipate heat transferred from the lighting device.

2. The refrigerator of claim 1, wherein the door body includes a body plate that is made of metal and defines a front surface of the door body, the body plate facing the rear surface of the panel assembly.

3. The refrigerator of claim 2, wherein the door body further includes:

a door liner defining a rear surface of the door body;

an upper cap decoration defining an upper surface of the door body;

a lower cap decoration defining a lower surface of the door body; and an insulation member provided in a space that is defined by the body plate, the door liner, the upper cap decoration, and the lower cap decoration.

4. The refrigerator of claim 1, wherein the light supporter is made of at least one of aluminum or copper.

5. The refrigerator of claim 1, wherein the heat dissipation member is provided in a plate-shaped sheet and is attached to a front surface of the back cover.

6. The refrigerator of claim 1, wherein the back cover is provided in a plate-shaped sheet.

7. The refrigerator of claim 1, wherein the light supporter includes:

a seating portion that defines a bottom surface of the light supporter and is disposed below the lighting device to support the lighting device; and a contact portion that extends upward from a rear end of the seating portion and is in contact with the heat dissipation member.

8. The refrigerator of claim 7, wherein the seating portion is in contact with the lighting device.

9. The refrigerator of claim 7, wherein a front surface of the heat dissipation member is in contact with the contact portion, and a rear surface of the heat dissipation member is in contact with a front surface of the back cover.

10. The refrigerator of claim 3, wherein the lower cap decoration includes:

a lower surface portion defining a lower surface of the door body;

a first coupling portion coupled to the panel assembly and disposed at a front of the lower surface portion;

a second coupling portion coupled to the door liner and disposed at a rear of the lower surface portion; and a third coupling portion coupled to the body plate and disposed at an upper side of the lower surface portion.

11. The refrigerator of claim 10, wherein the lower cap decoration includes a handle that is recessed upward to allow a user to grip a bottom end of the door, and wherein a portion of the lower cap decoration defines a front of the handle and is spaced apart from the back cover to thereby define a space between the front of the handle and the back cover.

12. The refrigerator of claim 11, wherein an upper end of the heat dissipation member is located higher than a top of the handle.

13. The refrigerator of claim 1, wherein the panel assembly further comprises a lower bracket defining a bottom surface thereof, and wherein the lighting device is mounted on the lower bracket.

14. The refrigerator of claim 13, wherein the light supporter is fixed to and in contact with an inner surface of the lower bracket.

15. The refrigerator of claim 13, wherein the lighting device includes:

a substrate extending along the lower bracket; and a plurality of light sources arranged along the substrate, and wherein the light supporter accommodates the substrate.

16. The refrigerator of claim 1, wherein at least a portion of the lighting device is disposed in a region between upper and lower ends of the heat dissipation member.

17. The refrigerator of claim 1, wherein the heat dissipation member is made of at least one of a graphite sheet or a metal material.

18. The refrigerator of claim 1, wherein the heat dissipation member is disposed between the light supporter and the back cover.

19. The refrigerator of claim 1, wherein the panel assembly further comprises a light guide plate disposed rearward relative to the panel and configured to guide the light emitted from the lighting device to the panel, and wherein the heat dissipation member is disposed between the light guide plate and the back cover.

20. The refrigerator of claim 1, wherein the heat dissipation member has a size corresponding to a width of the back cover.

* * * * *